US011804121B2

(12) United States Patent
Stewart et al.

(10) Patent No.: US 11,804,121 B2
(45) Date of Patent: Oct. 31, 2023

(54) HUMAN PRESENCE DETECTOR DEVICE

(71) Applicant: Lenovo (Singapore) Pte. Ltd., Singapore (SG)

(72) Inventors: Aaron M. Stewart, Raleigh, NC (US); Ellis Anderson, Greensboro, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 17/220,901

(22) Filed: Apr. 1, 2021

(65) Prior Publication Data

US 2022/0319300 A1 Oct. 6, 2022

(51) Int. Cl.

| | |
|---|---|
| ***G08B 21/22*** | (2006.01) |
| ***G08B 5/36*** | (2006.01) |
| ***F21V 23/04*** | (2006.01) |
| ***G08B 27/00*** | (2006.01) |
| ***G08B 3/10*** | (2006.01) |

(52) U.S. Cl.

CPC ..... *G08B 21/22* (2013.01); *F21V 23/0442* (2013.01); *G08B 3/10* (2013.01); *G08B 5/36* (2013.01); *G08B 27/005* (2013.01)

(58) Field of Classification Search

CPC . G08B 21/22; G08B 3/10; G08B 5/36; G08B 27/005; F21V 23/0442

See application file for complete search history.

(56) References Cited

U.S. PATENT DOCUMENTS 4,476,461 A * 10/1984 Carubia ..... G07B 13/02 340/539.1
4,993,049 A * 2/1991 Cupps ..... G06M 1/101 250/338.1
5,221,919 A * 6/1993 Hermans ..... G08B 13/193 250/342
5,243,326 A * 9/1993 Disabato ..... G08B 29/046 250/221
5,576,972 A * 11/1996 Harrison ..... G01S 13/04 702/128
5,626,417 A * 5/1997 McCavit ..... F21V 23/0442 362/276
5,640,143 A * 6/1997 Myron ..... H05B 47/13 340/541
5,701,117 A * 12/1997 Platner ..... H05B 47/12 340/567
5,703,367 A * 12/1997 Hashimoto ..... G08B 13/193 250/342
5,703,368 A * 12/1997 Tomooka ..... G08B 13/19 250/349
5,861,806 A * 1/1999 Vories ..... G08B 5/36 340/555
5,877,688 A * 3/1999 Morinaka ..... G08B 13/191 340/584
6,147,608 A * 11/2000 Thacker ..... G08B 7/06 340/331

(Continued)

*Primary Examiner* — Hai Phan
*Assistant Examiner* — Son M Tang
(74) *Attorney, Agent, or Firm* — Brian J. Pangrle

(57) ABSTRACT

A device can include a stand that includes a base and a pole; and a monitoring unit coupled to the pole, where the monitoring unit includes a sensor and a status indicator that changes from an unoccupied illumination to an occupied illumination responsive to detection via the sensor of human presence in a region.

20 Claims, 15 Drawing Sheets

(56) References Cited

U.S. PATENT DOCUMENTS 6,222,191 B1 * 4/2001 Myron ..... G08B 13/193 250/353
6,292,100 B1 * 9/2001 Dowling ..... G08B 13/08 340/545.6
6,309,090 B1 * 10/2001 Tukin ..... G08B 7/06 362/276
6,587,049 B1 * 7/2003 Thacker ..... G08B 5/00 340/331
7,079,027 B2 * 7/2006 Wojcik ..... A01M 31/002 340/539.26
7,154,399 B2 * 12/2006 Cuddihy ..... G08B 21/028 340/573.1
7,800,049 B2 * 9/2010 Bandringa ..... G08B 29/183 250/239
8,350,714 B2 * 1/2013 Trim ..... G08B 21/22 340/686.6
8,456,318 B2 * 6/2013 Bender ..... H01H 9/22 340/815.42
9,442,017 B2 * 9/2016 Read ..... G01J 5/0025
9,538,613 B1 * 1/2017 Jacobs ..... H05B 47/11
9,600,999 B2 * 3/2017 Stenzler ..... G06V 20/48
9,606,261 B2 * 3/2017 Shimizu ..... G01J 5/0025
9,711,018 B2 * 7/2017 Messiou ..... G01J 1/0411
9,865,147 B2 * 1/2018 Langford ..... G08B 5/36
10,502,634 B2 * 12/2019 Baum ..... G01K 1/143
10,634,380 B2 * 4/2020 Kostrun ..... G01J 5/0025
11,073,602 B2 * 7/2021 Yang ..... G07C 9/00
11,109,465 B2 * 8/2021 Krishnamurthy ..... H04W 24/10
2008/0277486 A1 * 11/2008 Seem ..... H04L 67/125 236/49.3
2011/0241886 A1 * 10/2011 Receveur ..... A61B 5/1117 340/573.4
2012/0168627 A1 * 7/2012 DeLeeuw ..... G01P 3/36 250/340
2013/0053063 A1 * 2/2013 McSheffrey ..... G08B 7/066 455/456.1
2013/0076517 A1 * 3/2013 Penninger ..... A61G 7/018 340/573.4
2013/0099092 A1 * 4/2013 Lin ..... G06F 3/0423 250/206.1
2013/0234625 A1 * 9/2013 Kondo ..... H05B 47/115 315/313
2013/0284931 A1 * 10/2013 Nagahisa ..... G01J 1/46 250/349
2013/0342131 A1 * 12/2013 Recker ..... H02J 50/40 315/292
2014/0036076 A1 * 2/2014 Nerayoff ..... G06V 20/62 348/148
2015/0097687 A1 * 4/2015 Sloo ..... F24F 11/34 340/632
2015/0213702 A1 * 7/2015 Kimmel ..... G06T 7/20 382/103
2015/0336015 A1 * 11/2015 Blum ..... G06V 20/54 472/137
2015/0338548 A1 * 11/2015 Cortelyou ..... G06V 20/52 250/214.1
2016/0138976 A1 * 5/2016 Schilz ..... G01J 5/12 250/338.1
2016/0140827 A1 * 5/2016 Derenne ..... A61B 5/747 340/573.7
2016/0150614 A1 * 5/2016 Randolph ..... H05B 45/46 315/153
2016/0204949 A1 * 7/2016 Theunissen ..... H05B 47/18 307/1
2016/0205747 A1 * 7/2016 Verbrugh ..... H05B 47/185 315/130
2016/0260019 A1 * 9/2016 Riquelme Ruiz ..... A47B 95/00
2017/0176185 A1 * 6/2017 Maar ..... G01C 15/06
2017/0243458 A1 * 8/2017 Langford ..... G08B 5/36
2017/0314997 A1 * 11/2017 Baum ..... G01J 5/0859
2017/0364817 A1 * 12/2017 Raykov ..... G06Q 10/00
2018/0217292 A1 * 8/2018 Grosse-Puppendahl ..... G01V 8/20
2018/0284319 A1 * 10/2018 Hergott ..... A47C 1/13
2018/0322767 A1 * 11/2018 Weber ..... G01V 8/10
2018/0345109 A1 * 12/2018 Hackett ..... A63B 71/0619
2019/0030195 A1 * 1/2019 Hatti ..... A61L 2/24
2019/0087696 A1 * 3/2019 Verhoeven ..... H05B 47/115
2019/0387884 A1 * 12/2019 Jacobs ..... A47C 7/622
2020/0072814 A1 * 3/2020 Bailey ..... G01N 29/045
2020/0073011 A1 * 3/2020 Abboud ..... G01S 17/50
2020/0228759 A1 * 7/2020 Ryan ..... H04N 7/188
2020/0258364 A1 * 8/2020 Quilici ..... G01S 17/58
2020/0285295 A1 * 9/2020 Bachrany ..... H03K 17/955
2020/0290567 A1 * 9/2020 Funyak ..... B60R 25/34
2020/0378758 A1 * 12/2020 Yang ..... G08B 21/0469
2020/0388039 A1 * 12/2020 Roth ..... G08B 21/182
2020/0412070 A1 * 12/2020 Owen ..... H05K 5/03
2021/0027208 A1 * 1/2021 Clark ..... G06Q 10/109
2021/0088334 A1 * 3/2021 Bembenek ..... G01C 15/06
2021/0350689 A1 * 11/2021 Kelly ..... G08B 21/245
2022/0150019 A1 * 5/2022 Xiao ..... H04L 5/0053
2022/0167490 A1 * 5/2022 Berg ..... G01R 19/16533

* cited by examiner

HUMAN PRESENCE DETECTOR DEVICE

TECHNICAL FIELD

Subject matter disclosed herein generally relates to detectors for human presence.

BACKGROUND

Humans may come into an environment, stay an amount of time and then leave the environment.

SUMMARY

A device can include a stand that includes a base and a pole; and a monitoring unit coupled to the pole, where the monitoring unit includes a sensor and a status indicator that changes from an unoccupied illumination to an occupied illumination responsive to detection via the sensor of human presence in a region. Various other devices, apparatuses, assemblies, systems, methods, etc., are also disclosed.

BRIEF DESCRIPTION OF THE DRAWINGS

Features and advantages of the described implementations can be more readily understood by reference to the following description taken in conjunction with examples of the accompanying drawings.

DETAILED DESCRIPTION

Figure 1:
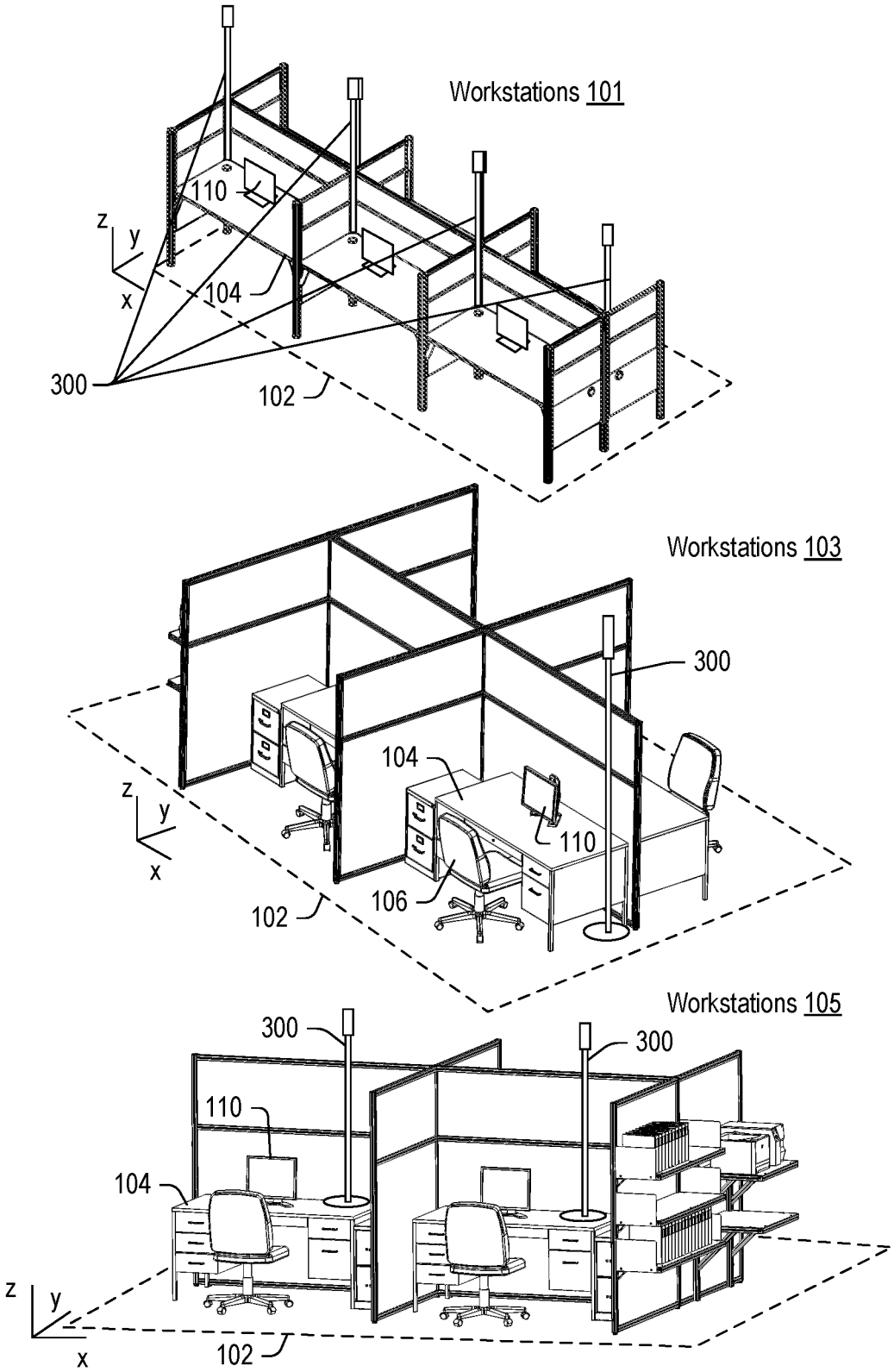
FIG. 1 is a series of perspective views of examples of workstations.

The following description includes the best mode presently contemplated for practicing the described implementations. This description is not to be taken in a limiting sense, but rather is made merely for the purpose of describing the general principles of the implementations. The scope of the invention should be ascertained with reference to the issued claims.

As an example, a human presence detector can be a device (e.g., a human presence detector device) that can include a stand that includes a base and a pole; and a monitoring unit coupled to the pole, where the monitoring unit includes a sensor and a status indicator that changes from an unoccupied illumination to an occupied illumination responsive to detection via the sensor of human presence in a region. As an example, a human presence detector device may be referred to as a human presence detection device.

As an example, a system may include one or more of such devices where, for example, the devices may transmit and/or receive signals from one another. In such an example, the system may include short range signaling, which may optionally be passed from one device to another, etc. For example, a change in light emitted by one device may be detected by another device that thereby triggers an action in the other device.

As an example, a device can include a pole-mounted sensor and an indicator where the device may be utilized for occupancy and utilization measurements within an environment. As an example, a device may be operable as a stand-alone unit. For example, a device may include circuitry and optionally its own power source that can power the circuitry. In various instances, a device may include a power cord such that it can be plugged into a socket (e.g., a DC socket, an AC socket, etc.). As an example, a power cord may be an Ethernet cable where power is provided by a power over Ethernet (PoE) standard (e.g., consider an RJ-45, etc., type of plug or connector).

As an example, a device can be adjustable such that it can sense within a desired region within an environment. For example, consider an adjustable pole (e.g., a telescoping pole) that can be adjusted upwardly and/or downwardly in height to achieve a desired field of view (FOV) in which humans may be detected. In various examples, a device may be manually and/or automatically adjusting. As an example, to guide manual adjusting, a device may include indicators (e.g., numbers, graphics, etc.) that can guide a user as to a height adjustment or other adjustment as to a FOV. As to automatic adjusting, a device may detect the presence of objects such as divider walls, desks, chairs, computers, displays, etc., and adjust its height accordingly. In such an example, detection of one or more humans may aid in automatic adjusting.

As an example, a device may be suitable for use in one or more office environments, for example, where employees share desk spaces (e.g., individual desks that are not assigned), meeting spaces and/or communal areas. In such environments, facilities professionals, site occupiers and/or property owners may benefit from data as to what spaces are being utilized. Such data may be desired for a particular amount of time and/or during one or more time periods (e.g., days of the week, time of day, etc.). In such environments, a device that can be readily set up for data acquisition, directing people, etc., can save time and resources. For example, consider a device that can be positioned near a cluster of workstations where the device can be readily set up by a human and/or automatically by itself for monitoring human presence at one or more of the cluster of workstations.

As to guiding human movements, consider a device that can illuminate a light once a human is detected where the light may remain illuminated while the human is present. In such an example, the light may change color when the human is not present, where the color may optionally transition in a manner dependent on time and/or one or more events. For example, if a human was present at a workstation and then is not present at the workstation for 10 minutes, a device may transition from emitting red illumination (e.g., occupied) to emitting yellow illumination where yellow indicates that the workstation is to be cleaned. In such an example, once cleaned, the device may transition to emitting green illumination (e.g., ready for occupation). In instances where a filling or occupancy order is desired, a transition to red by one device may trigger a neighboring device to emit green. For example, consider transitioning from no illumination or red or other "do not occupy" illumination to green to allow one or more humans to see that a workstation is available for occupancy.

As an example, a device may be utilized by itself, with other instances of the device (e.g., as a fleet, etc.), and/or with one or more fixed devices or systems (e.g., consider video cameras fixedly mounted to a wall, a ceiling, etc.). As an example, a fleet of devices may be monitored by an overarching device that may have a view of the fleet of devices. For example, consider a welcome desk or kiosk that can have a device that can see a fleet of devices. In such an example, the device may be an instance of the other device but operable in a management mode for fleet management, fleet assessment, etc. In such an example, the fleet observation device may be similarly flexible and easy to position and set up (e.g., manually, semi-automatically, automatically, etc.).

As an example, a device or fleet of devices may be implemented in combination with one or more types of presence sensors that can be mounted under individual desks and tables, mounted on walls or installed overhead in the ceiling. Such sensors installed at individual stations may provide for granular information but with the additional burden of granular installation and management. Wall-mounted and overhead sensors may have an ability for capturing information across a broader range of space (e.g., literally a broader view) but with hard installation demands and costs (e.g., power and data cabling to be uniquely drawn to the sensor location).

As explained, a device can include features that offer quick installation, optionally leveraging existing power outlet locations (e.g., plugs, PoE, etc.). Such a device may also provide for easy relocation along with any adjustments, which, as mentioned, may be automatic. In contrast to a video camera that may be discrete (e.g., hidden or inconspicuous), a device can be positioned in a manner where it is meant to be seen (e.g., visible to a human entering a space). As an example, where a sight impaired individual is present, a device may include a speaker or other component that can generate sound that may guide such an individual to an appropriate location. In such an example, once an individual is at a station, the device may switch off sound generation. For example, consider a device or a fleet of devices that can recognize a white cane and/or a seeing-eye dog. In such examples, a device may transition from a silent mode to an audible mode where a device or a fleet of devices may coordinate audible emissions to guide the individual to an appropriate station.

As an example, a device or a fleet of devices may be designed to be conspicuous, seen and/or heard. In such an example, each of the devices may serve as a point of interaction for one or more of those who utilize a space in real-time.

As an example, a device can be of a particular form factor that provides for a sensor mount. For example, consider a small, stable base plus an extendible, vertical pole on which a sensor is mounted or a group(s) of sensors are mounted.

As an example, a device can be an assembly that can stand independently on its own without side support. For example, consider a floor base that can be positioned on a horizontal, substantially level floor. In such an example, the device may include a power cord that can be readily connected to a power supply outlet (e.g., as may be installed in a wall or a floor according to building code, etc.).

As an example, a base may be a disc shaped base, a polygonal shaped base, a multi-legged base (e.g., a tripod base), or another type of suitable base. As an example, a base may include one or more wheels. For example, consider a base that may be positioned without lifting it off a support surface (e.g., a floor, a desktop, a shelf, etc.). As an example, a device can include a battery or battery where at least one is located in a base or otherwise below a monitoring unit to thereby reduce the center of mass of the device.

As an example, a device can be of a relatively low mass and/or of a relatively low center of mass such that risk of tipping over is reduced. As an example, a device can have a relatively small overall footprint that can allow placement near a wall, in a room corner, proximal to furniture or other fixtures or installations of a space as well as be positioned between adjacent pieces of furniture (e.g. adjacent desks, etc.).

As an example, a device can include features that allow for elevation of one or more sensors that may allow for control of a sensor's vantage point view (e.g., for a desired FOV). In such an example, the device may be adjustable via a pole such as a telescopic pole. As explained, a device can include increments or indications on a pole that can help indicate a range of sensing achievable with a respective sensor height.

As an example, a device may include one or more features that provide for mounting of one or more indication lights and/or full display(s) such as mounted on a visible portion(s) of a pole. As an example, a device can include a shelf, a hook, etc., where such a feature may be configured in a manner that aims to reduce instability. For example, consider a pole that bifurcates into two branches where a platform may be disposed between the two branches and/or a hook positioned at a juncture where the two branches rejoin. In such an example, an item may be positioned on the platform and/or hung on the hook where mass of the item remains substantially along an axis of the pole (e.g., and over a base or footprint of the device). As an example, a portion of a pole may be stationary while another portion is moveable for adjustment. As an example, a hook and/or a platform may be stationary and/or adjustable.

As an example, a device may indicate status of a region, a workstation, an environment, etc. For example, consider an indication of whether a space is closed or open, dirty or clean, occupied to a level, not occupied to a level, vacant or not vacant, etc. As an example, an indication may be provides for an identifier for a particular individual or type of individual (e.g., a person's name, a team color, etc.). As an example, a device may provide a time indicator, which may include a count-down type of indicator (e.g., an hour glass, etc.) that can indicate how long a space may be assigned, occupied, booked, etc.

As an example, a device and/or a fleet of devices may be operable as part of an alert system. For example, consider audible alert and/or visual alert. For example, consider a power outage where a device can include its own battery that may power an indicator (e.g., an emergency light) when power at an outlet shuts off or otherwise becomes unstable. As an example, where a device includes a motion sensor (e.g., an accelerometer, image sensor, etc.), a device may issue a warning such as an earthquake warning. As a device may be configured as a pole, a sensor at or near an end of the pole may be particularly sensitive to motion such that it may sway in a manner that can be sensed via an accelerometer, a gyroscope, a camera, or other type of sensor. As to a camera, the FOV of the camera may change as it sways which may be detected via image analysis circuitry. Where a thermal sensor is present that can sense thermal energy, swaying of the thermal sensor may similarly be an indicator of seismic activity. In various examples, a device or a fleet of devices may operate as beacons (e.g. visually and/or audibly) for wayfinding (e.g., direction to an exit, a safe room, etc.).

As an example, a device can include a human presence sensor that can detect the presence of a human, directly and/or indirectly. In such an example, the device may be used for one or more of workstation occupancy and workstation booking.

As an example, a device can be a "smart office" device that increases digital intelligence of an office. For example, consider an office environment that can include one or more workstations that can be utilized in a shared manner. Such an approach to humans and spaces may be referred to as "hoteling".

Hoteling involves office management in which workers can dynamically schedule their use of workspaces such as desks, cubicles, and offices. Often, it may be viewed as an alternative approach to the more traditional method of permanently assigned seating. Hoteling may include managing via one or more of first-come-first-served (e.g., FCFS), reservation-based unassigned seating, reservation-based assigned seating, etc. As an example, hoteling can include management of seating via a practice referred to as "hot desking", where a worker may choose a workspace upon arrival, which may be from a variety of workspaces, a select group of workspaces, etc.

As an example, hoteling can include a human reserving a workstation for temporary use for a period of time, which may be minutes, hours, days, etc. Hoteling can be in some instances more efficient than a one-workstation-per-human scenario (e.g., one-workstation-per-employee, contractor, etc.). Hoteling may create various opportunities for people to mingle and collaborate.

Hoteling has been viewed as a practice driven at least in part by increased worker mobility (e.g., as enabled by advances in mobile technology, etc.). For example, organizations whose workers travel frequently, or with growing remote or mobile workforces, can be suitable for hoteling. Hoteling, in some instances, reflects a shift from an employer's office space being a main "office base" to being more of a come-and-go "hospitality hub." With an increasing trend of work-from-home, an office space may demand lesser space, fewer workstations, etc., though, depending on health concerns, with various measures to increase sanitation, reduce risk of transmissible pathogens, etc.

As an example, a workspace with workstations may include one or more devices that can be utilized for tasks such as booking, collection of utilization data, etc.

As an example, a device can include one or more connectors such as, for example, a USB type of connector. For example, consider a device that can be powered via a USB connector where an AC/DC converter may be provided to convert AC power at an outlet to DC power for powering the device.

FIG. 1 shows various examples of workstations 101, 103 and 105. As shown, each of the workstations 101, 103 and 105 can be supported on a floor 102 and include one or more desktops 104 where, for example, one or more chairs 106 may be positioned at the one or more desktops 104 or not. In the examples of FIG. 1, the workstations 101, 103 and 105 can include one or more display devices 110, for example, each positioned on a corresponding one of the one or more desktops 104 and/or other workstation portion (e.g., wall, frame, etc.). As shown, each of the one or more desktops 104 can include a corresponding device 300. In such an example, the device 300 may be referred to as a pole device where a pole allows for a desirable FOV for human presence detection.

In FIG. 1, Cartesian coordinate systems (x, y and z) are shown, which may be utilized to describe one or more features of a workstation, a desktop, a display device, a chair, a user, a frame, a wall, a floor, a device, a height of a device, etc.

Figure 2A:
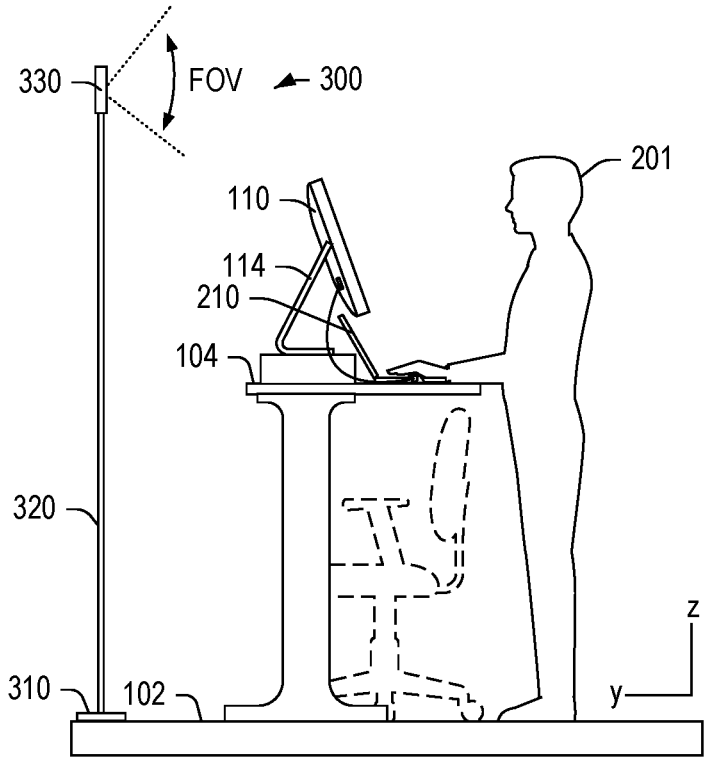
FIG. 2A and FIG. 2B are views of an example of a user at a workstation.

FIG. 2A shows an example of a user 201 standing on the floor 102 before the desktop 104 of a workstation where the display device 110 is supported by the desktop 104 via a stand 114 and where a computing device 210 can be connected to the display device 110. As shown, the device 300 can have a FOV that can be achieved at least in part via a height of the device 300 where a sensor of the device 300 can utilize the FOV for detecting the presence of the user 201.

Figure 2B:
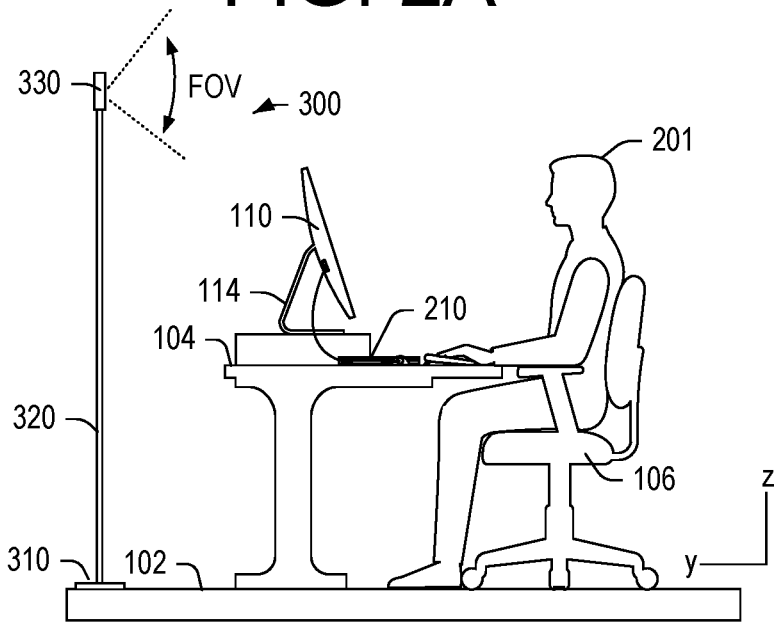

FIG. 2B shows an example of the user 201 seated on the chair 106 before the desktop 104 of a workstation where the display device 110 is supported by the desktop 104 via the stand 114 and where the computing device 210 can be connected to the display device 110. As shown, the device 300 can have a FOV that can be achieved at least in part via a height of the device 300 where a sensor of the device 300 can utilize the FOV for detecting the presence of the user 201.

In the examples of FIG. 2A and FIG. 2B, the height of the device 300 may differ. For example, the height of the device 300 may be diminished for the scenario of FIG. 2B when compared to the scenario of FIG. 2A. For example, the device 300 can include a base 310 and a telescopic pole 320 where a unit 330 can be at or proximate to an end 324 of the telescopic pole 320.

Figure 3:
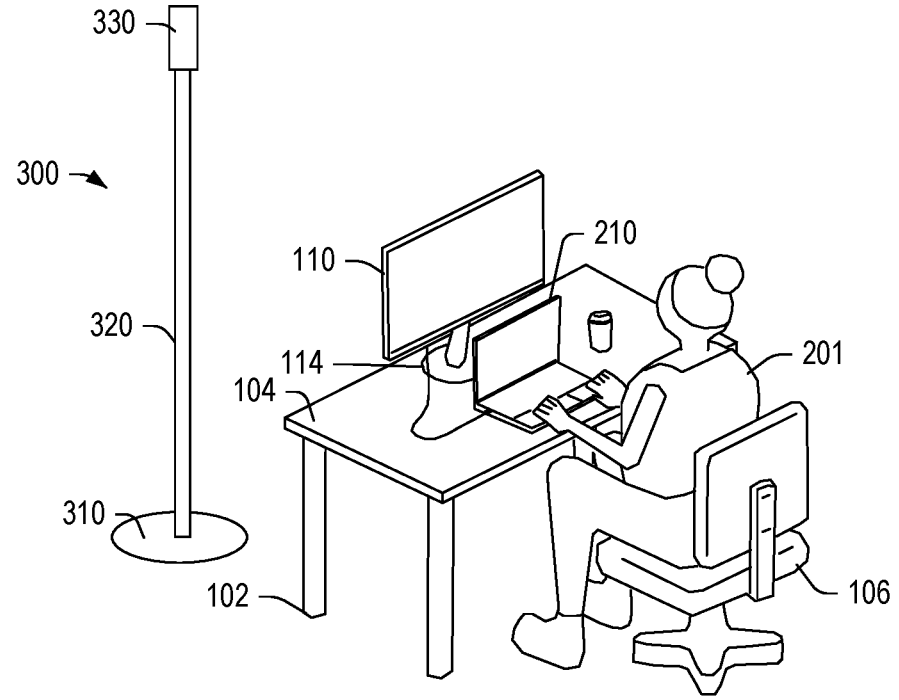
FIG. 3 is a perspective view of an example of a device at a workstation and a schematic view of an example of a portion of the device.
Figure 3:
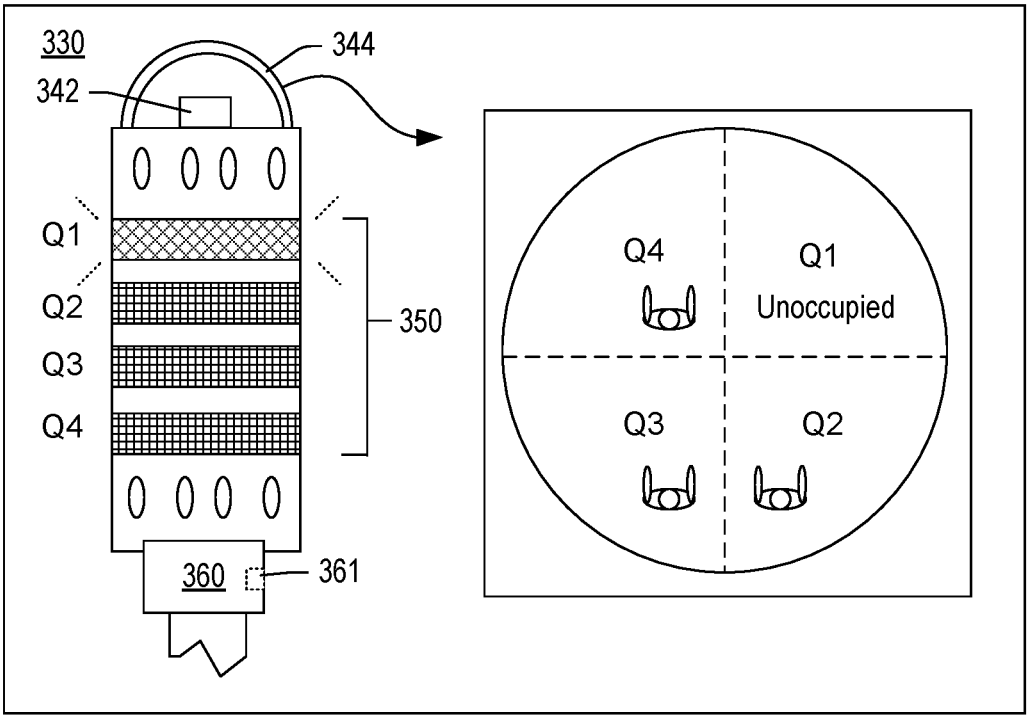

FIG. 3 shows an example of the device 300 that is positioned in an environment that includes at least one station where the user 201 is seated on the chair 106 supported on the surface 102 in front of the desk 104 where the display device 110 is supported via the stand 114 on the desk 104. Also shown is the computing device 210, which may be a clamshell form factor computing device.

The unit 330 of the device 300 may be a sub-assembly of the device 300 that includes various components. For example, the unit 330 can be a sub-assembly that includes one or more sensors, one or more lights, one or more types of circuitry, etc. In the example of FIG. 3, the unit 330 is shown as including a camera 342 with a lens 344 and a light array 350. As an example, the camera 342 may capture an image of a region of the environment (e.g., via a FOV) where circuitry 360 may process the captured image and identify partitions such as the quadrants Q1, Q2, Q3 and Q4. For example, consider one or more image analysis techniques that may detect line (e.g., edge detection, etc.) where lines can be analyzed to determine partitions. Edge detection can be performed as a type of image processing for finding boundaries of objects within images where it may rely on detecting discontinuities in brightness (e.g., intensity), color, etc. An image analysis technique may provide for image segmentation such that segments can be processed to identify one or more partitions. As an example, the device 300 may include one or more controllers, microcontrollers, etc., which may be or include one or more digital signal processors (e.g., DSPs, etc.). In the example of FIG. 3, the unit 330 may include one or more ports 361, which may provide power and/or data (e.g., consider one or more USB types of ports or other types of ports).

As shown, the unit 330 can determine that Q1 is unoccupied while Q2, Q3 and Q4 are occupied. In response, the unit 330 can cause the light array 350 to illuminate in a manner that indicates that Q1 is unoccupied and/or that Q2, Q3, and Q4 are occupied.

As an example, the light array 350 may include a number of individual elements that can be illuminated or not depending on a number of identified partitions. For example, where 2 partitions are identified, there may be two rings of light; whereas, for 10 partitions, there may be 10 rings of light. As an example, the device 300 may be utilized on a one to one basis, one per station, or on a one to many basis, one per multiple stations.

As explained, the device 300 may include features that can operate to self-discern the division of occupy-able spaces (e.g., partitions) where the device may be able to segment occupancy status indicators accordingly (e.g., to a number of partitions).

As an example, a number of partitions may depend on one or more FOVs. For example, consider the device 300 as including multiple cameras and/or multiple lenses (e.g., an insect eye, etc.) and/or a fisheye lens. As an example, the device 300 may have 360 degree vision about the pole 320 with a suitable angle of view. As an example, status indicators for partitions where present may be ordered in a top down or bottom up manner or, for example, in a manner that mimics how the partitions are arranged. As an example, an ID may be presented via a display of the device 300 such that a user may readily associate a station with a status. In such an example, a station may include an ID such that a user can readily match IDs.

As an example, the device 300 can include wired and/or wireless circuitry, which may operate via one or more protocols. As mentioned, the device 300 may be able to signal and detect signals when in a fleet where such signaling and detecting are without a particular network protocol (e.g., rather a customized protocol for the fleet). As to network protocols, the device 300 may include circuitry for Ethernet, WiFi, LiFi, BLUETOOTH, LTE, 5G, etc. and/or one or more custom communication mechanism (e.g., proprietary device to device, to a proprietary hub, host, etc.).

As explained, in various instances, an operator of stations in an environment may desire a relatively easy and rapid way to deploy human presence detection for one or more purposes. Where a device such as the device 300 is utilized, deployment may be facilitated. Further, where the device 300 includes features for automatic set up and/or adjustments, an operator may be able to merely position one or more of the devices 300 and let them do their job, optionally collecting data during operation, post-operation, etc.

As explained, a telescopic pole can include one or more markings, notches, etc., that can correspond to a range of sensing in a given setup. Such an approach may help facilitate set up, without an operator having to guess and/or check sensor range. As an example, a device may include circuitry that can adjust one or more parameters such as focus, depth of field, etc., in a manner that depends on range, which may depend on height of a pole. For example, consider a FOV increasing with increased height where focus may provide for a greater depth of field such that near and far objects and/or humans are in focus.

Figure 4:
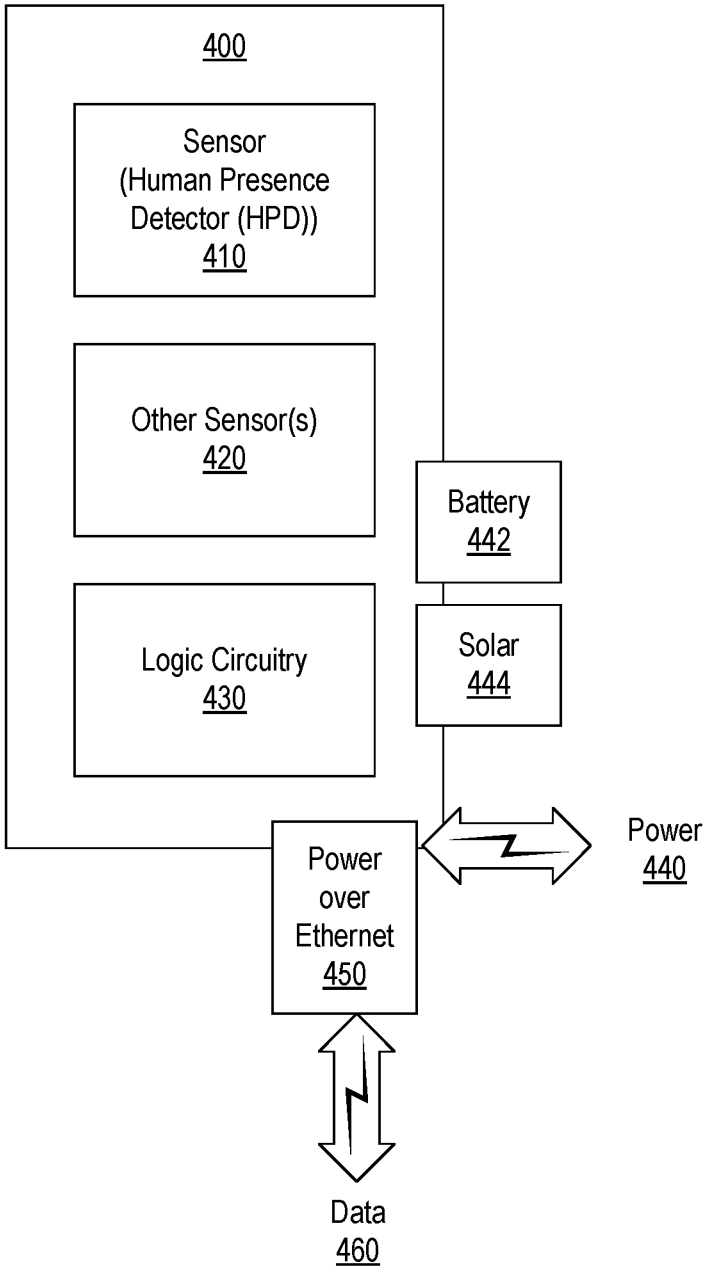
FIG. 4 is a block diagram of example features of a device.

FIG. 4 shows example unit components 400 where one or more may be included in the device 300. As shown, the unit components 400 can include a sensor 410 such as a human presence detection (HPD) sensor, one or more other sensors 420, logic circuitry 430, a power connector 440, one or more batteries 442, one or more solar cells 444, and a PoE connector 450, which may communicate power and/or data. As explained, a device may be stand-alone and battery operated and/or stand-alone and pluggable, such as pluggable into a power socket (e.g., AC, DC, etc.).

Figure 5:
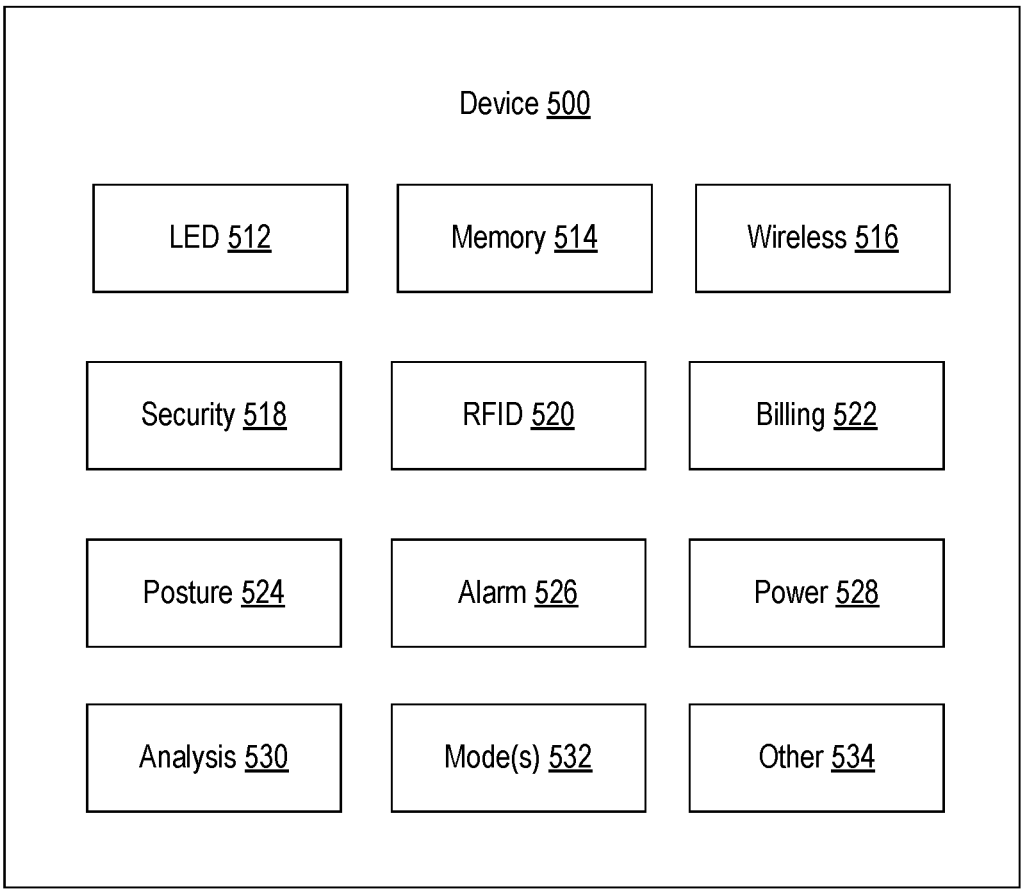
FIG. 5 is a block diagram of example features of a device.

FIG. 5 shows examples of unit components 500 where one or more may be included in the device 300. As shown, the unit components 500 can include one or more LEDs 512, memory 514, wireless circuitry 516, security circuitry 518, RFID circuitry 520, billing circuitry 522, posture circuitry 524, alarm circuitry 526, power circuitry 528, analysis circuitry 530, mode circuitry 532 and one or more other types of circuitry 534.

As an example, the security circuitry 518 may monitor one or more users switching stations where a user may be assigned to a particular station.

As an example, as to the RFID circuitry 520, it may provide for transmission of information and/or identification of the device 300, for example, via a RFID scanner. In such an example, an operator may scan a fleet of the devices 300 for inventory, etc.

As an example, as to billing circuitry 522, it may provide for usage time of a workstation according to information sensed by a HPD sensor and/or by connection information detected by circuitry of the device 300 (e.g., including a signal from a display device, etc.).

As an example, the posture circuitry 524 may utilize HPD sensor data and/or other data to determine whether a user has proper posture at a workstation. For example, consider a thermal sensor that can determine whether a user is slouching or sitting up straight. In such an example, where the user is slouching, the device 300 may issue a signal to remind the user to adjust his posture.

As an example, the alarm circuitry 526 may provide an alarm (e.g., silent or loud) responsive to movement of the device 300 (e.g., unauthorized movement, seismic movement, etc.). As mentioned, an alarm may be issued for an emergency such as a power outage. As an example, if a user attempts to tamper with the device 300, the alarm circuitry 526 may issue an alarm, which may be to a base station to alert a manager, etc. As an example, the alarm circuitry 526 may operate as an actual and/or a virtual leash such that an alarm is issued if the device 300 is greater than a distance from a station, etc.

As an example, the power circuitry 528 may manage power of the device 300, which may power down to a low power state when not in use. As an example, the power circuitry 528 may manage solar cell circuitry (see, e.g., FIG. 4) that may be utilized to charge a battery or otherwise power the device 300. As an example, the power circuitry 528 may detect a power outage, for example, via detection of power at a connector and/or via a transition in lighting (e.g., room lights going off, etc.).

As an example, the analysis circuitry 530 can provide for one or more types of analyses utilized one or more types of data, timers, etc., which may be generated by the device 300 and/or by one or more other instances of the device 300 (e.g., as in a fleet).

As an example, the mode circuitry 532 may provide for one or more types of display modes. For example, as explained the device 300 can include one or more types of lights, displays, etc.

As an example, the device 300 can include a fluid chamber that can carry one or more fluids. For example, consider a disinfecting fluid that can be stored in the chamber and emitted by the device 300. In such an example, the device 300 may emit disinfecting fluid after a user leaves a workstation, for example, responsive to lack of human presence per a HPD sensor. In such an example, a timer may be utilized to cause a pump to emit a spray of the fluid via one or more nozzles, etc., to cause droplets of the fluid to travel above and optionally onto at least a portion of a desktop. As an example, a fluid can be a scented fluid and/or a scent destroying fluid that may help to freshen-up air in an environment.

Figure 6A:
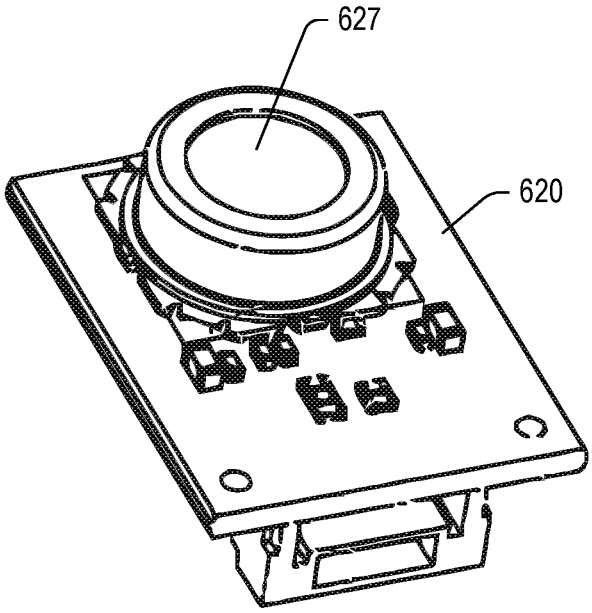
FIG. 6A and FIG. 6B are views of an example of a human presence detection sensor.
Figure 6B:
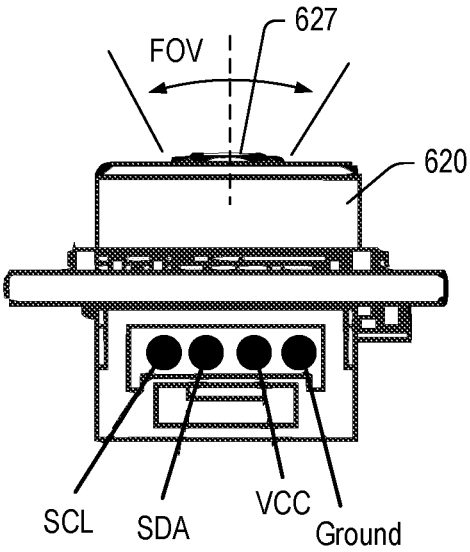

FIG. 6A and FIG. 6B show views of an example of a sensor 620 that can provide for human presence detection (e.g., a human presence sensor that can generate a signal indicative of human presence). For example, the sensor 410 of FIG. 4 may be the sensor 620 or another type of sensor. As an example, the device 300 may include multiple sensors where at least one of the sensors may be the sensor 620.

In the example of FIG. 6A and FIG. 6B, the sensor 620 can include one or more features of the D6T MEMS thermal sensor (OMRON Corporation). While both a pyroelectric sensor and a non-contact MEMS thermal sensor can detect even the slightest amount of radiant energy from an object such as infrared radiation and convert that energy into a temperature reading, the pyroelectric sensor relies on motion detection whereas the non-contact MEMS thermal sensor is able to detect the presence of a stationary human. As an example, a MEMS thermal (IR sensor) can measure the surface temperature of an object without touching the object when its thermopile element absorbs an amount of radiant energy from the object (e.g., a human). As to size, the sensor 620 can include a circuit board size that is, for example, less than approximately 20 mm×approximately 20 mm (e.g., 14 mm×18 mm, 11.6 mm×12 mm, etc.).

In FIG. 6B, a FOV is shown that corresponds to a silicon lens 627 that focuses radiant heat (far-infrared rays) emitted from an object onto a thermopile component. The thermopile component generates electromotive force in accordance with the radiant energy (far-infrared rays) focused on it. The values of this electromotive force and the internal thermal sensor are measured such that the measured value (temperature of the object) can be determined via an interpolation calculation that compares the measured values with an internally stored lookup table. As an example, the measured value can be output, for example, via an $I^2C$ interface (e.g., read using a host, etc.).

As to the lens 627, it may be made of a specialized silicon material. As an example, a suitable materials may be characterized as having a relatively high transmission for thermal energy (e.g., greater than approximately 50 percent, etc.) and may include protective or anti-refection coatings, for example, designed for a range of micron wavelength light, etc. As an example, consider a germanium (Ge) material designed to operate in an infrared portion of an EM spectrum (e.g., wavelength of approximately 1 to approximately 23 microns). As to some other examples, consider zinc selenide (ZnSe), float zone silicon, calcium fluoride, sapphire, specialized IR transmitting polymer, barium fluoride, etc. Such materials may span a range of wavelengths from approximately 0.1 microns to approximately 25 microns. Float zone silicon can be a particularly pure silicon material that may be produced via a process such as vertical zone melting. As an example, a material may be provided as a window and/or as a lens. For example, the D6T MEMS thermal sensor can include a specialized, high-performance silicon lens to focus infrared (IR) rays onto one or more thermopiles.

In FIG. 6B, the sensor 620 is shown as including a supply voltage contact, a ground contact and interface contacts labeled SCL (clock) and SDA (data). As an example, a device can include one or more USB-to-$I^2C$ adapters. For example, the SCL and SDA contacts may be operatively coupled to USB contacts such that a USB interface may provide for control of and/or receipt of values from the sensor 620.

As an example, the SCL and SDA contacts may provide for data transfer being initiated with a start condition (S) signaled by SDA being pulled low while SCL stays high, followed by SCL being pulled low where SDA sets the first data bit level while keeping SCL low. In such an example, data can be sampled (received) when SCL rises for the first bit (B1) where, for a bit to be valid, SDA does not change between a rising edge of SCL and the subsequent falling edge. Such a process can be repeated with SDA transitioning while SCL is low, and the data being read while SCL is high (B2, . . . , Bn). A final bit can be followed by a clock pulse, during which SDA is pulled low in preparation for the stop bit. A stop condition (P) can be signaled when SCL rises, followed by SDA rising.

As an example, a unit may include one or more sensors, which can include one or more thermal sensors and/or one or more other HPD sensors. As an example, a sensor unit can be or include an environmental sensor unit such as the 2JCIE-BU environment sensor unit (OMRON Corporation), which is a serial bus sensor unit (e.g., USB) that can output temperature (e.g., −10 deg C. to +60 deg C.), humidity (e.g., 30% RH to 85% RH), light (e.g., 10 lx to 2000 lx), barometric pressure (e.g., 700 hPa to 1100 hPa), sound noise (e.g., 37 dB to 89 dB), 3-axis acceleration, equivalent total volatile organic compounds (eTVOC), a discomfort index, a heat stroke warning level, vibration information (e.g., number of earthquakes, number of vibrations, spectral intensity value, etc.). Such a sensor unit can provide for determination of earthquakes based on vibrational acceleration and can provide for monitoring of room air quality (e.g., using a VOC sensor). The aforementioned sensor unit includes BLUETOOTH interface circuitry and USB interface circuitry.

As an example, the device 300 can include a port that can receive a connector where the connector can be a connector of a sensor unit. For example, consider the 2JCIE-BU environment sensor unit, which includes a male connector (e.g., USB type of connector). In such an example, a device can be optionally augmented with one or more additional sensors. As an example, the device 300 may include a port that may be a female port where an environmental sensor unit can be plugged into the port to operatively couple circuitry of the environmental sensor unit and circuitry of the device 300. As mentioned, in the example of FIG. 3, the unit 330 may include one or more ports 361. For example, the circuitry 360 may be operatively coupled to one or more ports, which may be internal and/or external that may be utilized for an environmental sensor unit (e.g., for supply of power, transmission of data, etc.).

As an example, the device 300 can include multiple sensors. In such an example, the multiple sensors may be utilized for one or more purposes. For example, if a user is a heavy typer, the user may make noise that could distract others in a shared workspace. In such an example, the sound noise sensor may generate signals (e.g., data, etc.) that can cause the device 300 to issue a notification. Additionally and/or alternatively, typing noise may be utilized as for purposes of confirming human presence. For example, if a sensor FOV becomes obstructed, the device 300 may assess sound noise sensor data to make a determination as to whether a human is present. The device 300 may be robust in its ability to detect and/or confirm (or deny) human presence. For example, if a person is passing by a workstation without using the workstation, a HPD sensor may indicate presence of a human while one or more other types of data indicate that human activity is not occurring at the workstation.

As an example, where one or more environmental sensors are included in the device 300 (e.g., or coupled to the device 300), the device 300 may generate data that can be displayed. For example, consider a display that can report on temperature, humidity, volatile organics, particles, etc.

As an example, where a workspace becomes crowded, the environment may become more filled with various components. As an example, an environmental sensor of the device 300 may include a carbon dioxide sensor, an oxygen sensor, a particulate matter sensor, etc. As an example, where carbon dioxide increases, oxygen decrease and/or particulate matter increases, that may indicate a drop in air quality. In such an example, a user may decide to leave the workstation and the workspace and/or otherwise notify a workspace manager; noting that the device 300 may include circuitry to automatically notify a workspace manager (e.g., via a wireless interface, etc.).

As an example, a workspace may include a plurality of devices where the workspace can monitor and/or control the workspace. As an example, a system may provide for monitoring workstations individually via individual instances of the device 300 at each of the workstations. Such monitoring can include usage monitoring and environmental monitoring. As an example, if a user complains about the environment at a workstation (e.g., or a neighboring workstation), a manager may be able to confirm whether or not a problem or problems existed. For example, a manger may access a computing device that can receive data and/or reports derived from data. In such an example, the manager may confirm that temperature and humidity were high such that comfort was compromised while a neighboring workstation user was typing loudly in a manner that caused noise. In such an example, a manager may be able to discount a bill or invoice for the user that complained, or otherwise provide credit or some other benefit. If the user would like a different workstation, the manager may be able to search for a set of conditions throughout available workstations that are likely to please the user such that the user can be assigned to another workstation. For example, the manager may view a GUI of a workspace that can render noise levels, comfort index, light intensity, etc., and then select a workstation within the workspace that is likely to meet the user's desired conditions. In such an example, a user profile may be stored such that upon a subsequent visit, the user can be recommended a particular available workstation.

As an example, a system for managing an environment that includes stations can include one or more instances of the device 300, each including a HPD sensor and optionally one or more environmental sensors. In such an example, user experience may be enhanced, particularly for users that desire particular conditions (e.g., noise, vibration, light intensity, air flow, temperature, humidity, etc.).

Figure 7:
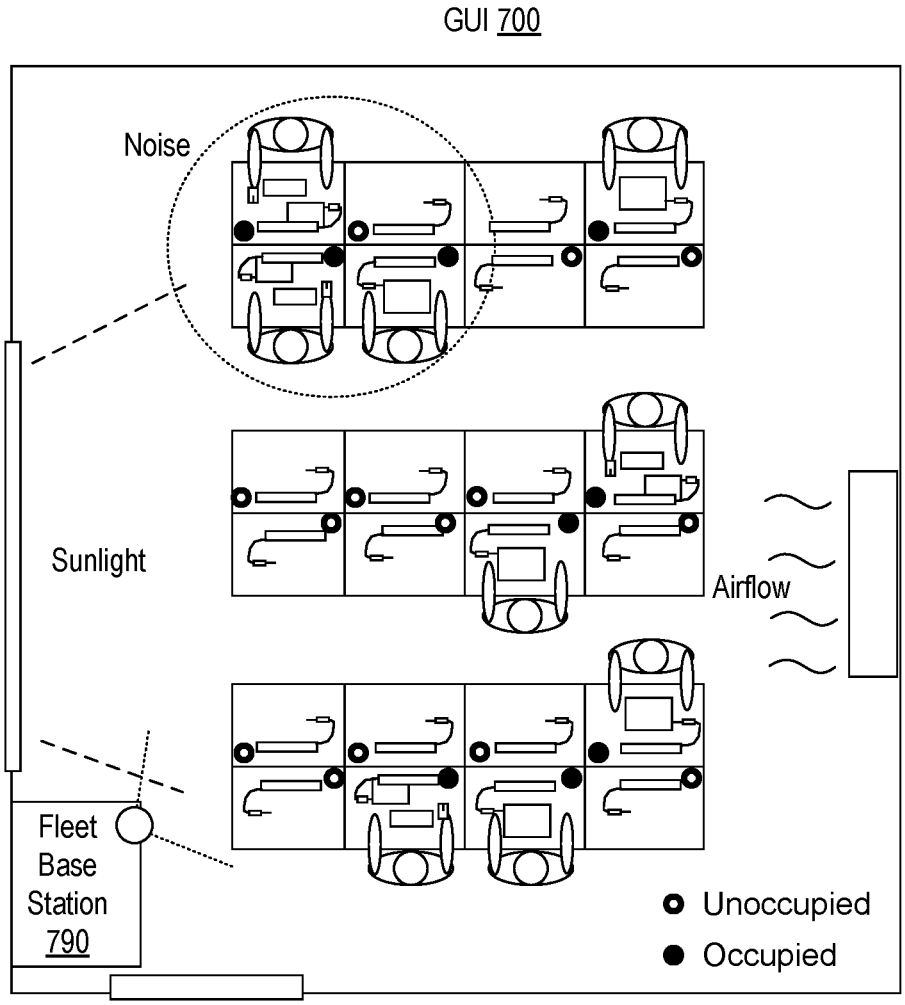
FIG. 7 is a diagram of an example of a graphical user interface.

FIG. 7 shows an example of a graphical user interface (GUI) 700 that includes a diagram of a workspace with 24 workstations. In the example of FIG. 7, the diagram may or may not include various features of the workspace such as, for example, windows, doors, concierge station, HVAC equipment (e.g., heating, air conditioning, filtration, etc. In such an example, the GUI 700 may be for an app such as a mobile device application and/or for a management device. In the example of FIG. 7, the GUI 700 shows indicators for noise, sunlight and airflow, which can be environmental conditions, along with indicators of users at 9 of the 24 workstations. As an example, where devices such as the device 300, etc., are included at each of the workstations or at least some of the workstations, one or more of various conditions can be monitored, which can include HPD and optionally one or more environmental conditions. In such an example, a user may select a workstation that is not occupied and that may have one or more conditions desired by the user. In such an example, the one or more conditions can include human presence (e.g., is a neighboring workstation occupied) and/or one or more environmental conditions (e.g., is the workstation in a sunny location, a noisy location, a breezy location, a hot location, a cold location, a poor air quality location, etc.).

As an example, a system can include a base station, such as, for example, the fleet base station 790, that can receive information from one or more instances of the device 300 that can be distributed in an environment. In such an example, the base station may include wired and/or wireless communication circuitry to receive information from the devices. For example, consider a WiFi and/or BLUETOOTH enabled base station that can receive information from WiFi and/or BLUETOOTH enabled devices. As mentioned, a device may include one or more ports that can provide for extensibility. For example, consider one or more of wireless communication extensibility, environmental sensor extensibility, HPD sensor extensibility, etc.

Figure 8:
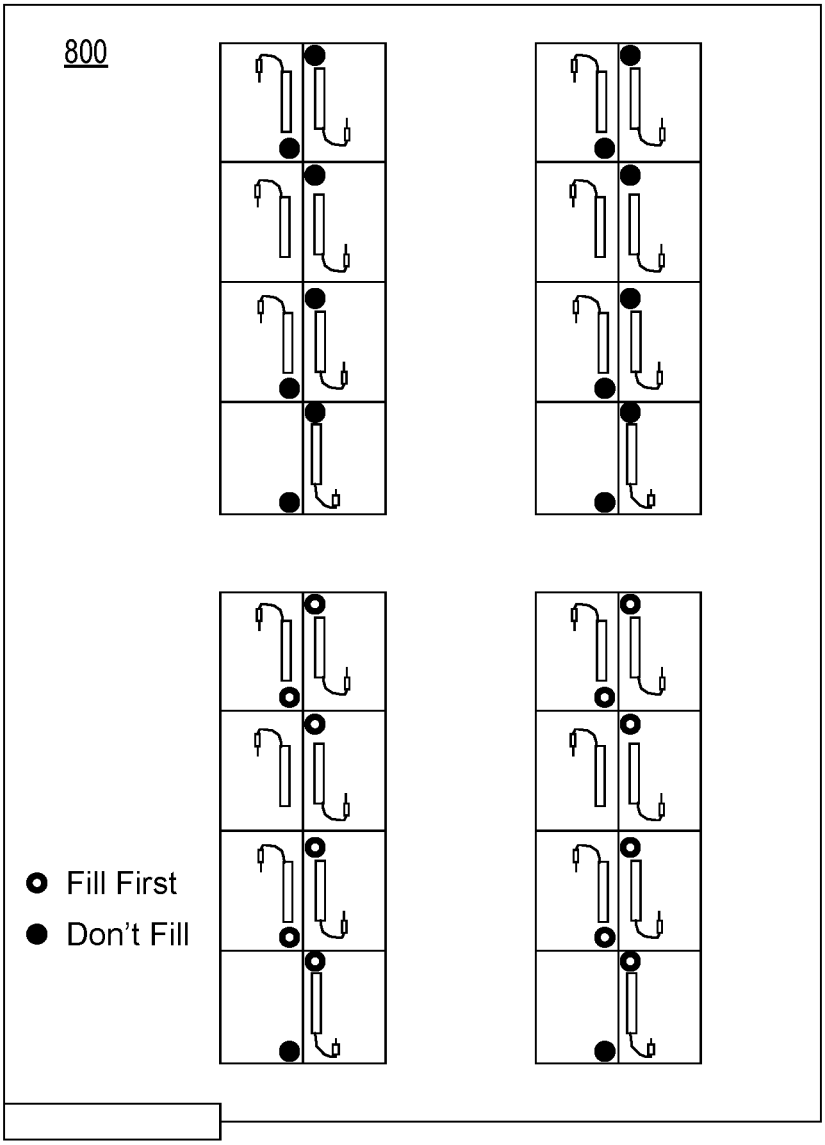
FIG. 8 is a diagram of an example of a graphical user interface and an example of a method.
Figure 8:
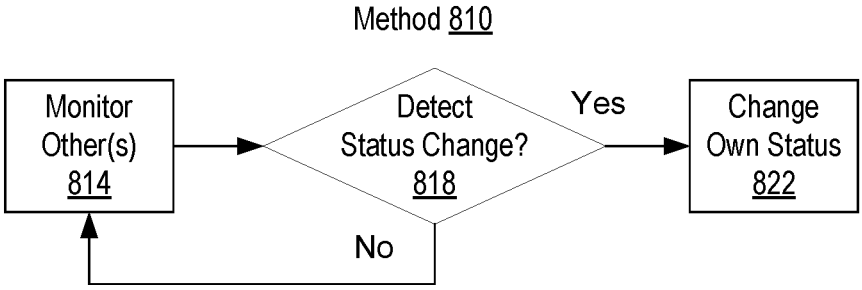
Figures 9A, 9B, 9C, 9D:
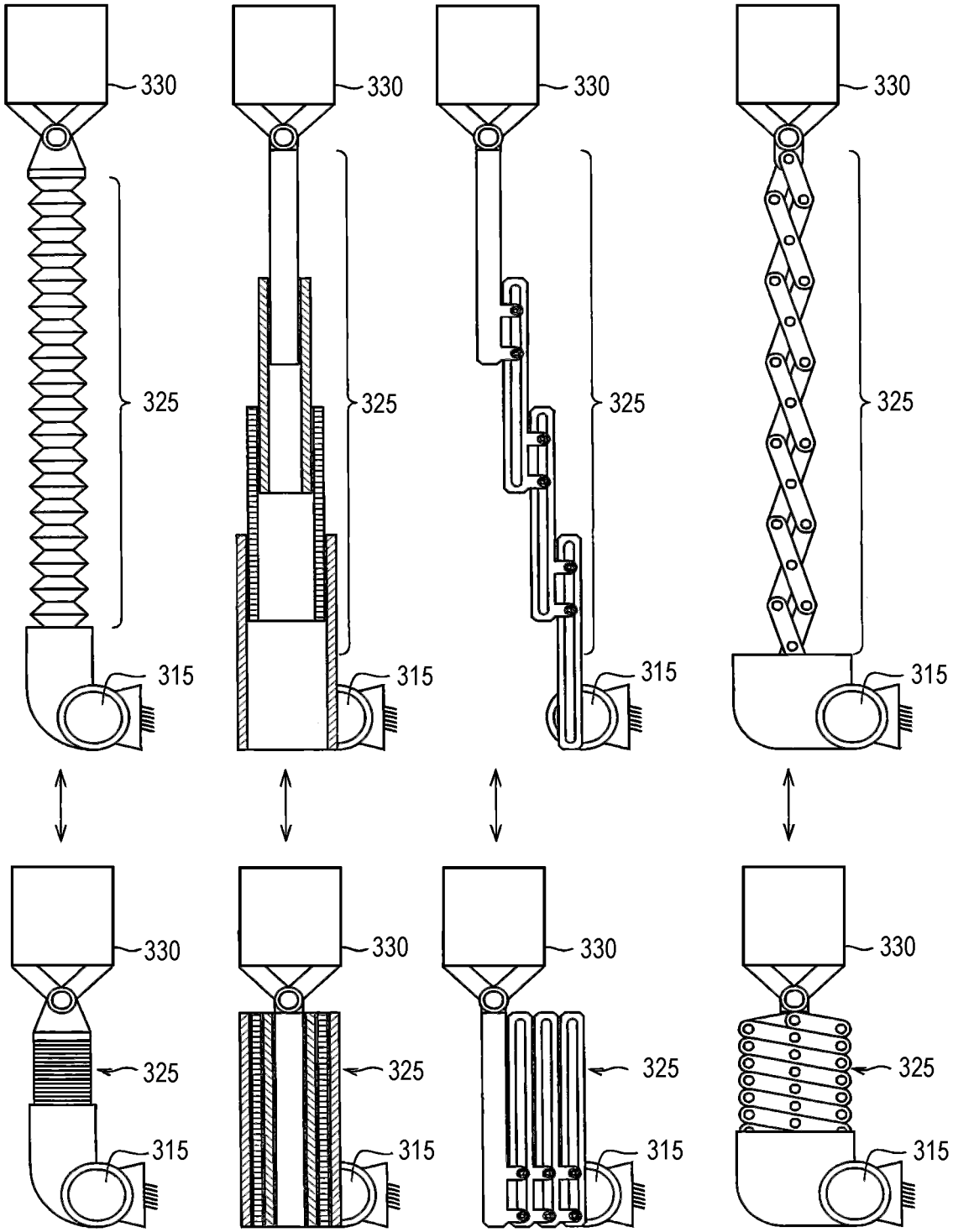
FIG. 9A, FIG. 9B, FIG. 9C and FIG. 9D are a series of diagrams of examples of telescopic poles.

FIG. 8 shows an example of a GUI 800 and a method 810. As shown, the GUI 800 can represent an environment with a number of the devices 300 where each of the devices 300 can indicate a status (see filled and open circles). The method 810 can include a monitor block 814 for monitoring one or more other devices, a decision block 818 for deciding whether a change in status has been detected in one or more other devices, and a change status block 822 where, per a "Yes" branch of the decision block 818, the device performing the monitoring may change its own status responsive to detecting a status change in the one or more other devices. As shown, per a "No" branch of the decision block 818, the method 810 may continue at the monitor block 814. In such an example, the environment may be filled in an organized manner. For example, a fill first approach may be taken for various stations such that once they are filled, one or more device may be triggered to change their own status to indicate availability for filling. Such an approach may be suitable for a restaurant environment where a restaurant owner may wish to fill seats next to an exterior window first, which may provide an appearance that people are present and eating at the restaurant. Once the window seats (e.g., stations) are filled, a device or devices may change status responsive to the presence of humans where such a change or changes can be automatically detected by one or more other devices associated with other seats (e.g., stations). In such a manner, patrons may be automatically guided via the devices to fill the seating (e.g., stations) of the restaurant in a particular order. While a restaurant is mentioned, such an ordered filling may be used for workspaces, test centers, waiting rooms, etc.

FIGS. 9A, 9B, 9C and 9D show various examples of the device 300 as including a telescopic pole 325 that may be manually adjusted and/or motorized via a coupling 315 (e.g., a gear box, etc.). As to manual adjustment, a user may turn a crank, pull on a portion of the telescopic pole, etc. As shown, the telescopic pole 325 can raise or lower the unit 330, which, as explained, may be in response to what is sensed such that the device 300 can automatically adjust its height for a suitable FOV. As an example, the device 300 can include one or more electric motors that may be utilized to cause a telescopic pole to increase in length and/or decrease in length. As explained, a feedback mechanism can exist such that circuitry determines when a FOV is appropriate, which may include adjusting until a number of partitions is constant where the partitions can correspond to stations to be monitored by the device 300.

Figure 10:
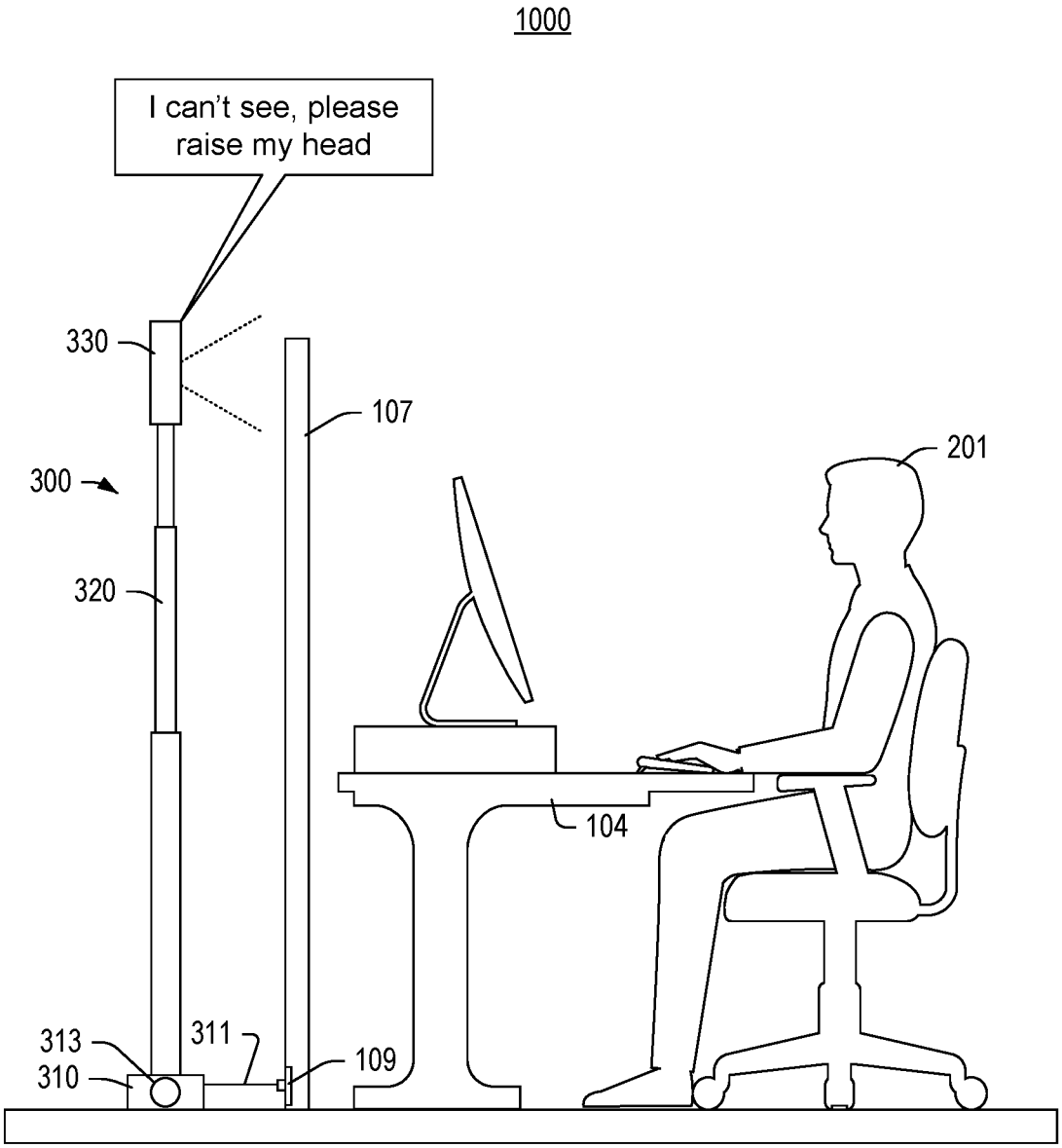
FIG. 10 is a diagram of an example of a scenario of operation of a device in an environment.

FIG. 10 shows an example scenario 1000 of an environment where a user 210 is at a station, particularly the desk 104. As shown, the device 300 may be positioned on the other side of a wall 107 where the wall 107 may have a power outlet 109. In such an example, the device 300 may include a power cord 311 that may extend from the base 310 or the pole 320 or the unit 330. As shown, the height of the unit 330 is not sufficient for the device 300 to have an appropriate FOV due to the height of the wall 107 being an obstacle. In such an example, the device 300 may take one or more actions. For example, consider an audible response where the device 300 issues a message stating "I can't see, please raise my head". Where the device 300 may include an electric motor 313 operatively coupled to the pole 320 being a telescopic pole, the electric motor 313 may be instructed via a signal generated at least in part by a sensor of the unit 330 such that the height of the pole 320 can be automatically adjusted for an appropriate FOV (e.g., one that sufficiently diminishes obstruction from an obstacle such as the wall 107). As to a manual adjustment, the pole 320 may include markings such as increments or indications that can help indicate the range of sensing achievable with a respective sensor height. In such an example, a user may adjust the pole 320 height using the markings until an appropriate FOV is achieved (e.g., which may be indicated via an audible signal, a visual signal, etc.).

As an example, the device 300 may be self-adjusting with feedback as to partitioning. For example, it may raise and/or lower itself until a number of partitions are identified with a relatively high level of certainty. In such an example, going to high may cause more partitions to be identified but one or more certainty metrics (e.g., probability of a partition being a real station, etc.) may be lacking compared to a lesser height that identifies fewer partitions with better certainty metric values.

Figure 11:
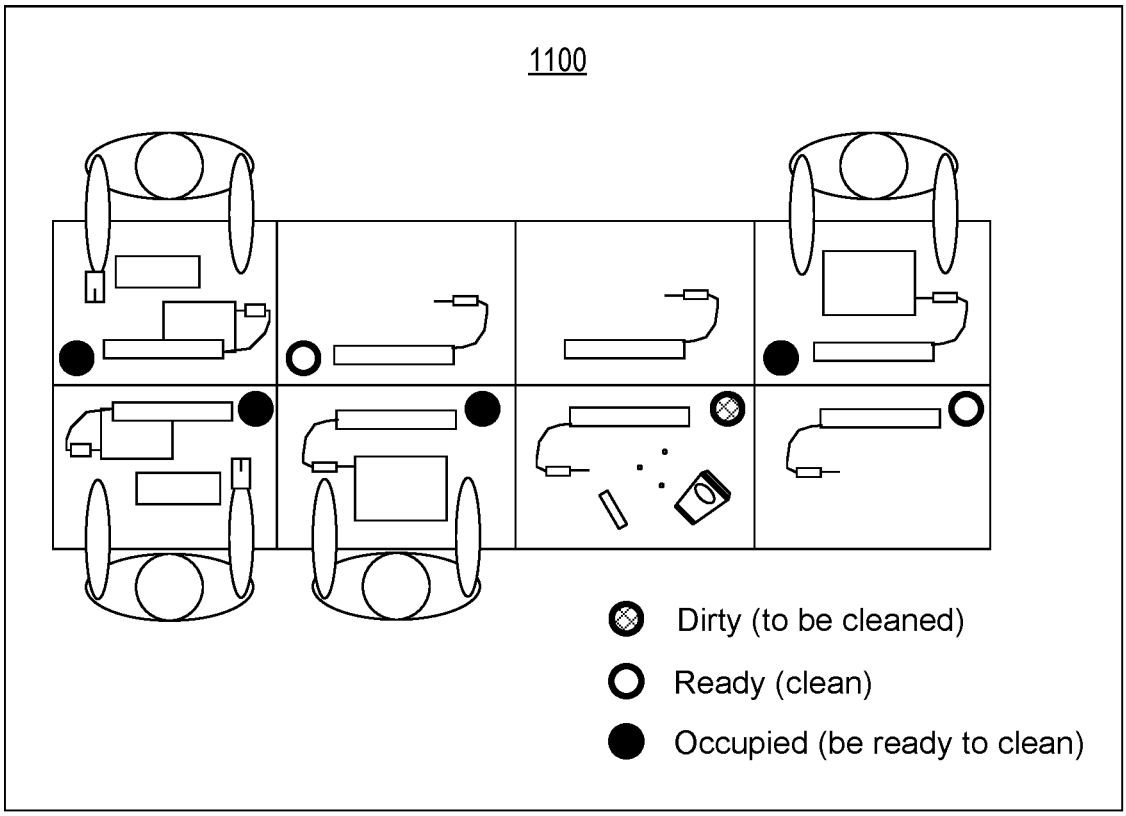
FIG. 11 is a diagram of an example of a graphical user interface and an example of a method.
Figure 11:
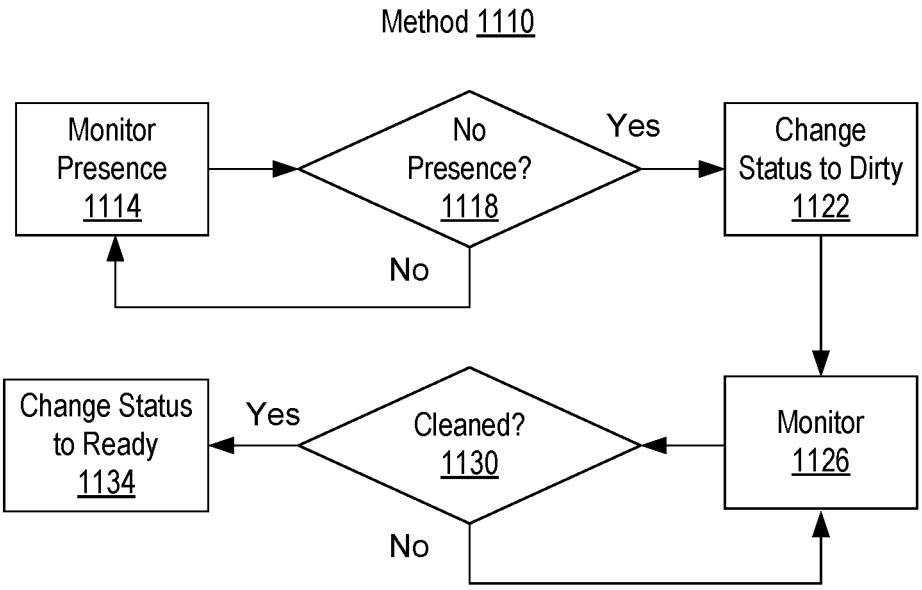

FIG. 11 shows an example of a GUI 1100 where various stations can be shown with respective status, which may be automatically determined by one or more of the devices 300. While the GUI 1100 shows individual status indicators on a one to one basis, as explained, the device 300 may monitor multiple stations with associated indicators (e.g., lights, which may be arranged as rings, bars, etc.). As shown, one station is dirty, two are ready and three are occupied while one may be non-functional and not indicated or indicated with or without illumination (e.g., not available, etc.).

FIG. 11 also shows an example of a method 1100 that includes a monitor presence block 1114 for monitoring presence, a decision block 1118 for deciding if there is no presence, a change block 1122 following a "Yes" branch of the decision block 1118 for changing status to dirty, a monitor block 1126 for monitoring the dirt, a decision block 1130 for deciding if the dirt is gone or the station clean, a change block 1134 following a "Yes" branch of the decision block 1134 for changing the status to ready where the change block 1134. In such an example, once the ready station is occupied (e.g., having human presence detected at the station), the method 1100 may continue at the monitor presence block 1114. As shown, a "No" branch of the decision block 1118 can cause the method 1100 to continue at the monitor presence block 1114 and a "No" branch of the decision block 1130 can cause the method 1100 to continue at the monitor block 1126.

Figure 12:
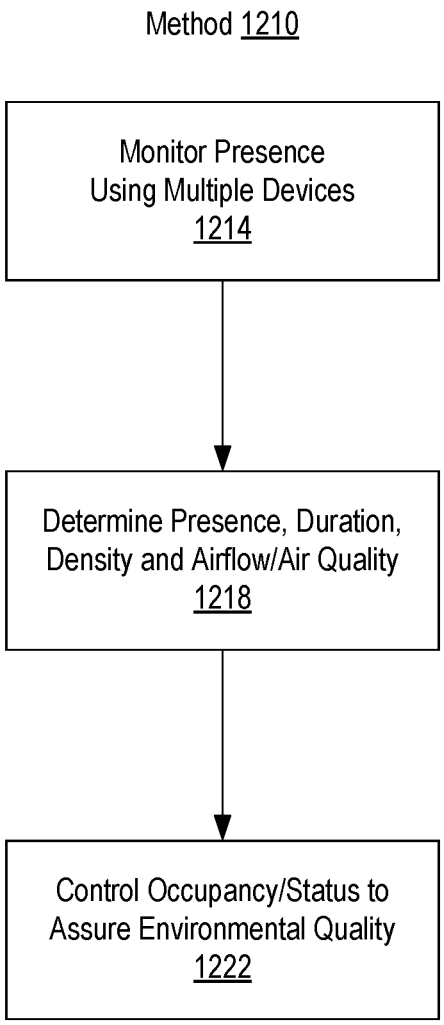
FIG. 12 is a diagram of an example of a method.

FIG. 12 shows an example of a method 1210 that includes a monitor block 1214 for monitoring presence using multiple devices, a determination block 1218 for determining presence, duration, density and airflow and/or air quality, and a control block 1222 for controlling occupancy in the environment and/or status of one or more of the multiple devices in an effort to assure environmental quality. For example, an environment may be subjected to various regulations such as occupancy, air flow, air quality, etc. The method 1210 may be utilized in a manner that can automatically patrol an environment, which may take the place of human patrol. In such an example, machine based control may be more acceptable to various individuals and/or station environment operators. Further, one or more of the devices may be programmed, manually and/or automatically, to operate in a manner that seeks to comport with regulations. For example, consider an occupancy regulation that changes from 25 percent to 50 percent as to percent of maximum occupancy. In such an example, a fleet of the devices 300 may operate individually in a coordinated manner that may help to adhere to a current regulation, a change in regulation, etc. Where one or more air quality metrics are subject to regulation, one or more of the devices 300 may provide for measurements and, for example, status, that can help to maintain air quality (e.g., one or more of the metrics) within the regulation. For example, consider particulate matter, $CO_2$ level, etc. In various instances, CO2 level can be related to human presence, which may be related to duration of presence, activity of human(s), number of humans, etc.

Figure 13:
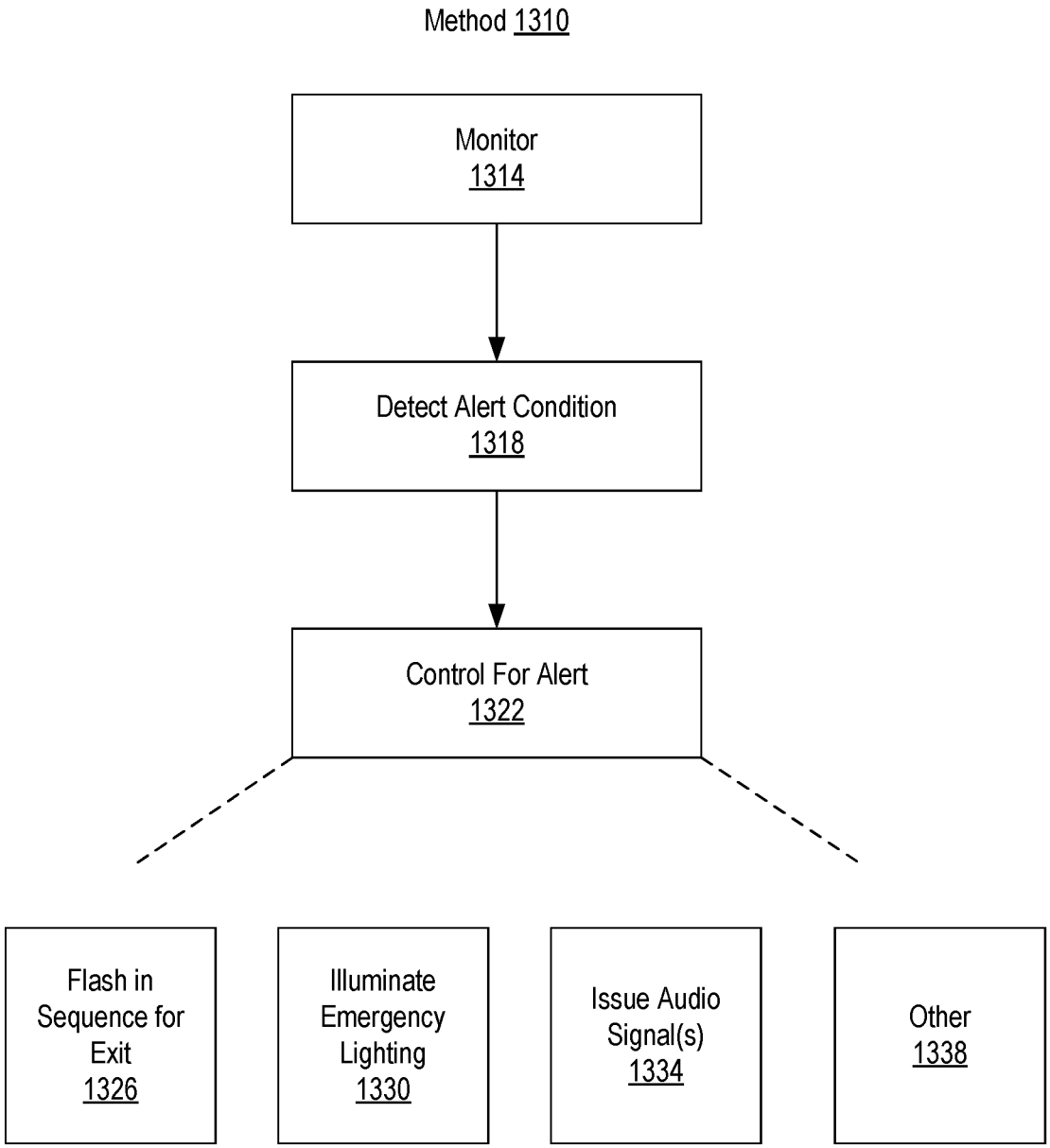
FIG. 13 is a diagram of an example of a method.

FIG. 13 shows an example of a method 1310 that includes a monitor block 1314 for monitoring in an environment, a detection block 1318 for detecting an alert condition, and a control block 1322 for control for an alert. For example, consider a control for an alert per the control block 1322 as being one or more of a flash in sequence for exit 1326, an illuminate emergency lighting 1330, an issuance of an audio signal or signals 1334, or one or more other actions 1338. In the example of FIG. 13, the method 1310 may be for an individual one of the devices 300 or for a fleet of the devices 300.

Figure 14:
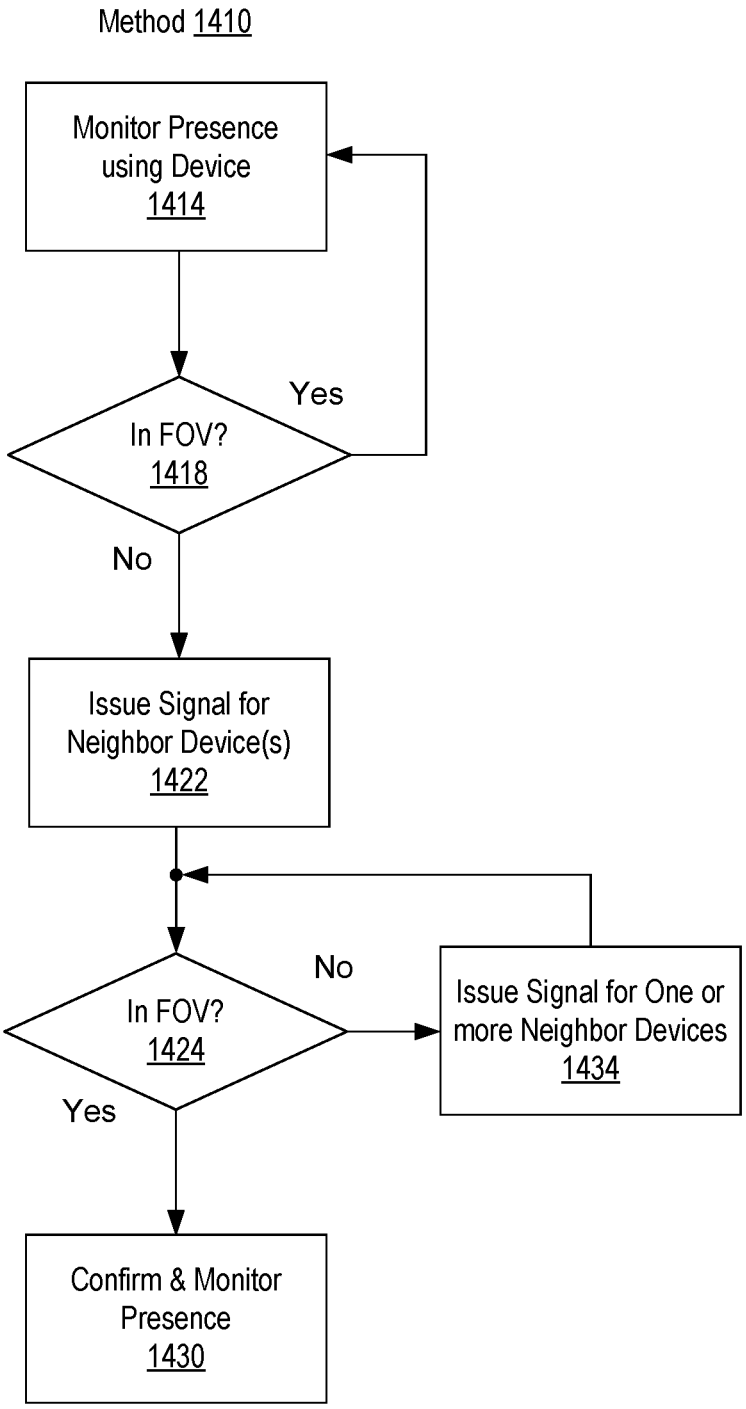
FIG. 14 is a diagram of an example of a method.

FIG. 14 shows an example of a method 1410 that includes a monitor presence block 1414 using a device, a decision block 1418 for deciding whether a human is in a FOV of the device, an issuance block 1422 that follows a "No" branch of the decision block 1418 for issuing a signal for one or more neighbor devices, a decision block 1424 that is for one of the signaled one or more neighbor devices to decide whether the human is in a FOV, a confirm presence block 1430 that follows a "Yes" branch of the decision block 1424 to confirm that the human has been located as being in the FOV of one of the one or more neighbor devices. As shown in the example of FIG. 14, a "Yes" branch of the decision block 1418 can cause the method 1410 to continue at the monitor presence block 1414 and a "No" branch of the decision block 1424 can cause the method 1410 to continue to another issuance block 1434 that can issue one or more signals for one or more additional neighbor devices. For example, if a device receives a signal and does not detect human presence within a certain amount of time, that device may issue a signal indicative of a lack of detection of human presence for the human such that one or more other devices may act to automatically try to detect presence of the human.

In such an example, a fleet of the devices 300 may act in a coordinated manner to track a human or humans in an environment.

As an example, a device can include a stand that includes a base and a pole; and a monitoring unit coupled to the pole, where the monitoring unit includes a sensor and a status indicator that changes from an unoccupied illumination to an occupied illumination responsive to detection via the sensor of human presence in a region. In such an example, the device may be for one station or one device may be utilized for multiple stations in a region.

As an example, a device can include logic that partitions a field of view of a sensor into sub-regions of a region where each of the sub-regions corresponds to a human occupy-able station. For example, consider a device that includes logic that can track four stations and can illuminate "occupied" upon filling of the fourth station or, for example, where the device can utilize rings of illumination, where three rings red and one ring green means one of four stations is open. As an example, a device may determine how many stations and how many rings to use (e.g., a controllable LED array, etc.).

As an example, a device can include multiple sensors, where each of the sensors includes a corresponding field of view. As an example, a device may include one or more thermal sensors for HPD and/or one or more visual/image sensors for HPD.

As an example, an unoccupied illumination can be a first color and an occupied illumination can be a second color that differs from the first color.

As an example, a device can include a pole that is adjustable in length to adjust a height of a monitoring unit. In such an example, the pole may be a telescopic pole (e.g., a pole that is telescoping in that it has an adjustable height).

As an example, a device can include a monitoring unit that is rotatable about an axis of a pole of the device.

As an example, a device can include a battery, where a sensor and a status indicator of the device are operatively coupled to the battery.

As an example, a device can include an emergency status indicator operatively coupled to a battery and actuatable responsive to detection of an environmental condition.

As an example, a device can include a power cable, for example, where the power cable may be a USB power cable, a AC power cable, a DC power cable, a power over Ethernet power cable, etc.

As an example, a device can include a pole that includes markings where the markings can correspond to a view of the sensor (e.g., a field of view, depth of field, range, etc.).

As an example, a device can include logic that issues a signal responsive to detection of an obstacle that diminishes a field of view of a sensor of the device to less than a field of view for a region, where, for example, the signal may be at least one of an audio signal and a visual signal. In such an example, the signal may persist until the field of view of the sensor includes the field of view for the region.

As an example, a device can include at least one environmental condition sensor (e.g., air flow, air quality, temperature, humidity, noise level, sunlight, etc.).

As an example, a device can include a timer, where the timer is triggerable responsive to a change in illumination of a status indicator (e.g., to commence a time measurement, etc.).

As an example, a device can include a timer, where the timer is operable to trigger a change in illumination of a status indicator (e.g., consider a time expired change, etc.).

As an example, a system can include a fleet of devices, where each of devices in the fleet includes a stand that includes a base and a pole and a monitoring unit coupled to the pole, where the monitoring unit includes a sensor and a status indicator; and a fleet monitoring unit that includes a fleet sensor and circuitry, where the circuitry, via the fleet sensor, monitors a status of the status indicator of each of the devices in the fleet. In such an example, the fleet monitoring unit can include an emitter that emits a signal receivable by at least one device in the fleet to control at least the status indicator of the at least one device. In such an example, within the fleet, there may be logic for device to device communication and/or triggering.

As an example, a method can include, in a fleet of devices, where each of devices in the fleet includes a stand that includes a base and a pole and a monitoring unit coupled to the pole, where the monitoring unit includes a sensor and a status indicator, detecting by a first one of the devices a change in the status indicator of a second one of the devices; and, responsive to the detecting by the first one of the devices, changing the status indicator of the first one of the devices.

The term "circuit" or "circuitry" is used in the summary, description, and/or claims. As is well known in the art, the term "circuitry" includes all levels of available integration (e.g., from discrete logic circuits to the highest level of circuit integration such as VLSI, and includes programmable logic components programmed to perform the functions of an embodiment as well as general-purpose or special-purpose processors programmed with instructions to perform those functions) that includes at least one physical component such as at least one piece of hardware. A processor can be circuitry. Memory can be circuitry. Circuitry may be processor-based, processor accessible, operatively coupled to a processor, etc. Circuitry may optionally rely on one or more computer-readable media that includes computer-executable instructions. As described herein, a computer-readable medium may be a storage device (e.g., a memory chip, a memory card, a storage disk, etc.) and referred to as a computer-readable storage medium, which is non-transitory and not a signal or a carrier wave.

Figure 15:
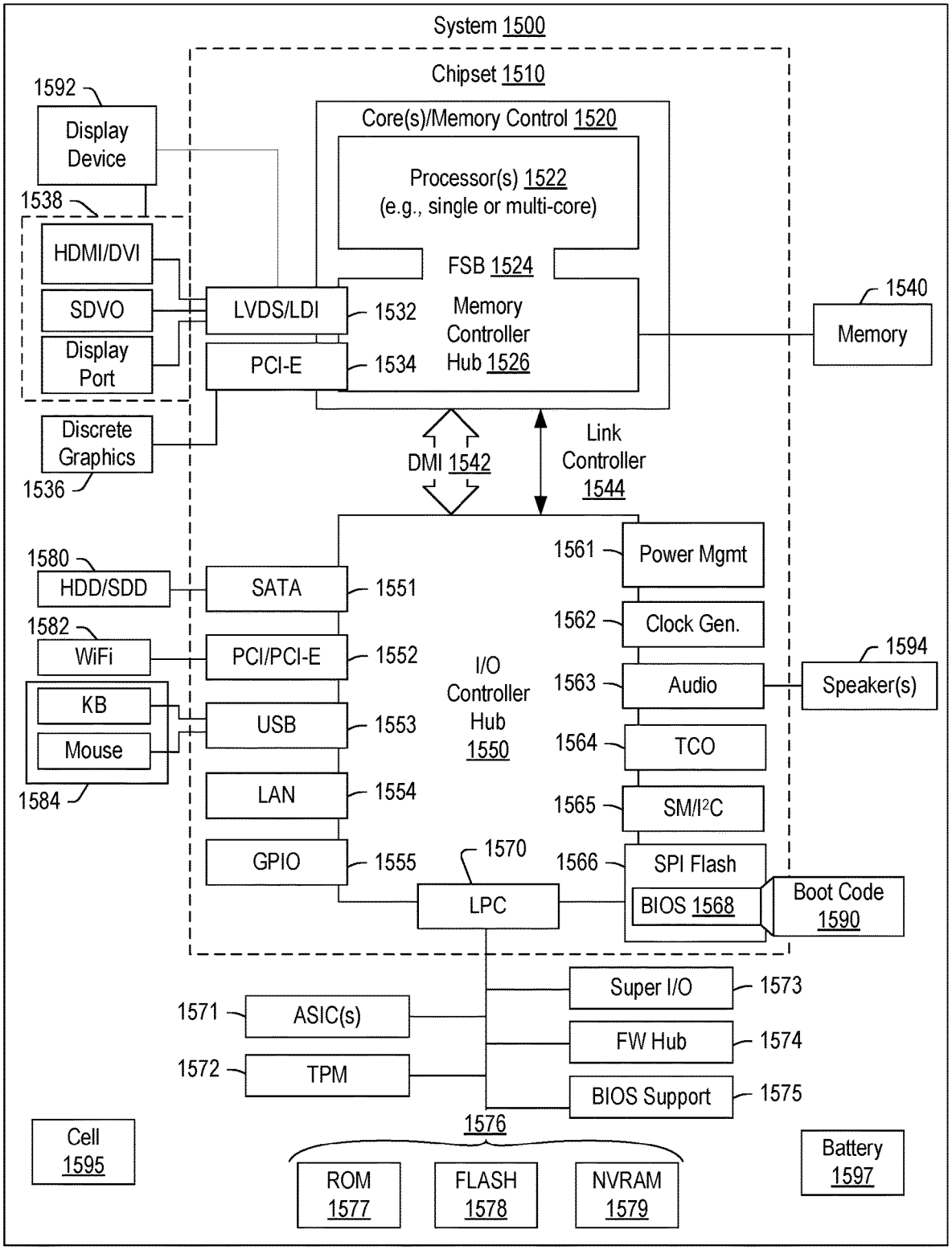
FIG. 15 is a block diagram of an example of a system that includes one or more processors and memory.

While various examples of circuits or circuitry have been discussed, FIG. 15 depicts a block diagram of an illustrative computer system 1500. The system 1500 may be a computer system, such as one of the ThinkCentre® or ThinkPad® series of personal computers sold by Lenovo (US) Inc. of Morrisville, N.C., or a workstation computer system, such as the ThinkStation®, which are sold by Lenovo (US) Inc. of Morrisville, N.C.; however, as apparent from the description herein, a system or other machine may include other features or only some of the features of the system 1500. As an example, the computing device 210 and/or the device 300 may include one or more features of the system 1500.

As shown in FIG. 15, the system 1500 includes a so-called chipset 1510. A chipset refers to a group of integrated circuits, or chips, that are designed (e.g., configured) to work together. Chipsets are usually marketed as a single product (e.g., consider chipsets marketed under the brands INTEL®, AMD®, etc.).

In the example of FIG. 15, the chipset 1510 has a particular architecture, which may vary to some extent depending on brand or manufacturer. The architecture of the chipset 1510 includes a core and memory control group 1520 and an I/O controller hub 1550 that exchange information (e.g., data, signals, commands, etc.) via, for example, a direct management interface or direct media interface (DMI) 1542 or a link controller 1544. In the example of FIG.

15, the DMI 1542 is a chip-to-chip interface (sometimes referred to as being a link between a "northbridge" and a "southbridge").

The core and memory control group 1520 include one or more processors 1522 (e.g., single core or multi-core) and a memory controller hub 1526 that exchange information via a front side bus (FSB) 1524. As described herein, various components of the core and memory control group 1520 may be integrated onto a single processor die, for example, to make a chip that supplants the conventional "northbridge" style architecture.

The memory controller hub 1526 interfaces with memory 1540. For example, the memory controller hub 1526 may provide support for DDR SDRAM memory (e.g., DDR, DDR2, DDR3, etc.). In general, the memory 1540 is a type of random-access memory (RAM). It is often referred to as "system memory".

The memory controller hub 1526 further includes a low-voltage differential signaling interface (LVDS) 1532. The LVDS 1532 may be a so-called LVDS Display Interface (LDI) for support of a display device 1592 (e.g., a CRT, a flat panel, a projector, etc.). A block 1538 includes some examples of technologies that may be supported via the LVDS interface 1532 (e.g., serial digital video, HDMI/DVI, display port). The memory controller hub 1526 also includes one or more PCI-express interfaces (PCI-E) 1534, for example, for support of discrete graphics 1536. Discrete graphics using a PCI-E interface has become an alternative approach to an accelerated graphics port (AGP). For example, the memory controller hub 1526 may include a 16-lane (x16) PCI-E port for an external PCI-E-based graphics card. A system may include AGP or PCI-E for support of graphics. As described herein, a display may be a sensor display (e.g., configured for receipt of input using a stylus, a finger, etc.). As described herein, a sensor display may rely on resistive sensing, optical sensing, or other type of sensing.

The I/O hub controller 1550 includes a variety of interfaces. The example of FIG. 15 includes a SATA interface 1551, one or more PCI-E interfaces 1552 (optionally one or more legacy PCI interfaces), one or more USB interfaces 1553, a LAN interface 1554 (more generally a network interface), a general purpose I/O interface (GPIO) 1555, a low-pin count (LPC) interface 1570, a power management interface 1561, a clock generator interface 1562, an audio interface 1563 (e.g., for speakers 1594), a total cost of operation (TCO) interface 1564, a system management bus interface (e.g., a multi-master serial computer bus interface) 1565, and a serial peripheral flash memory/controller interface (SPI Flash) 1566, which, in the example of FIG. 15, includes BIOS 1568 and boot code 1590. With respect to network connections, the I/O hub controller 1550 may include integrated gigabit Ethernet controller lines multiplexed with a PCI-E interface port. Other network features may operate independent of a PCI-E interface.

The interfaces of the I/O hub controller 1550 provide for communication with various devices, networks, etc. For example, the SATA interface 1551 provides for reading, writing or reading and writing information on one or more drives 1580 such as HDDs, SDDs or a combination thereof. The I/O hub controller 1550 may also include an advanced host controller interface (AHCI) to support one or more drives 1580. The PCI-E interface 1552 allows for wireless connections 1582 to devices, networks, etc. The USB interface 1553 provides for input devices 1584 such as keyboards (KB), one or more optical sensors, mice and various other devices (e.g., microphones, cameras, phones, storage, media players, etc.). On or more other types of sensors may optionally rely on the USB interface 1553 or another interface (e.g., $I^2C$, etc.). As to microphones, the system 1500 of FIG. 15 may include hardware (e.g., audio card) appropriately configured for receipt of sound (e.g., user voice, ambient sound, etc.).

In the example of FIG. 15, the LPC interface 1570 provides for use of one or more ASICs 1571, a trusted platform module (TPM) 1572, a super I/O 1573, a firmware hub 1574, BIOS support 1575 as well as various types of memory 1576 such as ROM 1577, Flash 1578, and non-volatile RAM (NVRAM) 1579. With respect to the TPM 1572, this module may be in the form of a chip that can be used to authenticate software and hardware devices. For example, a TPM may be capable of performing platform authentication and may be used to verify that a system seeking access is the expected system.

The system 1500, upon power on, may be configured to execute boot code 1590 for the BIOS 1568, as stored within the SPI Flash 1566, and thereafter processes data under the control of one or more operating systems and application software (e.g., stored in system memory 1540). An operating system may be stored in any of a variety of locations and accessed, for example, according to instructions of the BIOS 1568. Again, as described herein, a satellite, a base, a server or other machine may include fewer or more features than shown in the system 1500 of FIG. 15. Further, the system 1500 of FIG. 15 is shown as optionally include cell phone circuitry 1595, which may include GSM, CDMA, etc., types of circuitry configured for coordinated operation with one or more of the other features of the system 1500. Also shown in FIG. 15 is battery circuitry 1597, which may provide one or more battery, power, etc., associated features (e.g., optionally to instruct one or more other components of the system 1500). As an example, a SMBus may be operable via a LPC (see, e.g., the LPC interface 1570), via an $I^2C$ interface (see, e.g., the SM/$I^2C$ interface 1565), etc.

Although examples of methods, devices, systems, etc., have been described in language specific to structural features and/or methodological acts, it is to be understood that the subject matter defined in the appended claims is not necessarily limited to the specific features or acts described. Rather, the specific features and acts are disclosed as examples of forms of implementing the claimed methods, devices, systems, etc.

What is claimed is:

1. A device comprising:

a stand that comprises a base and a pole; and a monitoring unit coupled to the pole, wherein the pole is adjustable in length to adjust a height of the monitoring unit, wherein the monitoring unit comprises a sensor, logic that partitions a field of view of the sensor into sub-regions of a region wherein each of the sub-regions corresponds to a human occupy-able station in a room, a plurality of status indicators that comprises one status indicator for each of the sub-regions that changes from an unoccupied illumination to an occupied illumination responsive to detection via the sensor of human presence in a corresponding one of the sub-regions, and circuitry that controls the plurality of status indicators of the monitoring unit responsive to detection of one or more signals of one or more other monitoring units of one or more other devices for other human occupy-able stations in the room to provide a visual guide for automatically filling at least a portion of the human occupy-able stations in the room in a particular order.

2. The device of claim 1, comprising multiple sensors, wherein each of the sensors comprises a corresponding field of view.

3. The device of claim 1, wherein the unoccupied illumination is a signal that comprises a first color and wherein the occupied illumination is a different signal that comprises a second color that differs from the first color.

4. The device of claim 1, wherein the pole is a telescopic pole.

5. The device of claim 1, wherein the monitoring unit is rotatable about an axis of the pole.

6. The device of claim 1, comprising a battery, wherein the sensor is operatively coupled to the battery and each one of the plurality of status indicators is operatively coupled to the battery.

7. The device of claim 6, comprising an emergency status indicator operatively coupled to the battery and actuatable responsive to detection of an environmental condition.

8. The device of claim 1, comprising a power cable.

9. The device of claim 8, wherein the power cable is a power over Ethernet power cable.

10. The device of claim 1, wherein the pole comprises markings and wherein the markings correspond to a view of the sensor.

11. The device of claim 1, comprising logic that issues a signal responsive to detection of an obstacle that diminishes a field of view of the sensor to less than a field of view for the region, wherein the signal comprises at least one of an audio signal and a visual signal.

12. The device of claim 11, wherein the signal persists until the field of view of the sensor includes the field of view for the region.

13. The device of claim 1, comprising at least one environmental condition sensor.

14. The device of claim 1, comprising a timer, wherein the timer is triggerable responsive to a change in illumination of each one of the plurality of status indicators of each one of the sub-regions.

15. The device of claim 1, comprising a timer, wherein the timer is operable to trigger a change in illumination of each one of the plurality of status indicators of each one of the sub-regions.

16. A system comprising:

a fleet of devices that monitors human presence at human occupy-able stations in a room, wherein each one of the devices in the fleet comprises a stand that comprises a base and a pole and a monitoring unit coupled to the pole, wherein the monitoring unit comprises a sensor and at least one status indicator that emits light indicative of a status of at least one of the human occupy-able stations; and a fleet monitoring unit that comprises a fleet sensor and circuitry, wherein the circuitry, via the fleet sensor, monitors the status of the human occupy-able stations via the at least one status indicator of each one of the devices in the fleet that are within view of the fleet sensor, and wherein the fleet monitoring unit comprises an emitter that emits a signal receivable by at least one of the monitoring units of the fleet of devices to control at least the at least one status indicator of the at least one of the monitoring units of the fleet of devices to provide a visual guide for automatically filling at least a portion of the human occupy-able stations in a particular order.

17. A method comprising:

in a fleet of devices that monitor human presence at human occupy-able stations in a room, wherein each one of the devices in the fleet comprises a stand that comprises a base and a pole and a monitoring unit coupled to the pole, wherein the monitoring unit comprises a sensor and a status indicator that emits light indicative of a status of at least one of the human occupy-able stations, detecting by the sensor of a first one of the devices a change in light emitted by the status indicator of a second one of the devices; and responsive to the detecting by the first one of the devices, changing the light emitted by the status indicator of the first one of the devices, wherein the changing of the light emitted by the status indicator of the first one of the devices is a visual guide for automatically filling at least a portion of the human occupy-able stations in the room in a particular order.

18. The device of claim 1, wherein adjustment of the height adjusts the height of the sensor and the plurality of status indicators.

19. The system of claim 16, wherein the fleet sensor comprises at least one sensor that senses emitted light from each of the at least one status indicator of each one of the devices that are within view of the fleet sensor.

20. The system of claim 1, wherein the circuitry that controls the plurality of status indicators of the monitoring unit actuates the unoccupied illumination of one or more of the plurality of status indicators responsive to the detection to visually guide one or more humans to automatically fill one or more of the human occupy-able stations in the room.

* * * * *